US006791253B2

(12) United States Patent
Komatsu et al.

(10) Patent No.: US 6,791,253 B2
(45) Date of Patent: Sep. 14, 2004

(54) DISPLAY

(75) Inventors: Masaaki Komatsu, Kokubunji (JP); Masatoshi Shiiki, Musashimurayama (JP); Shin Imamura, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/174,969

(22) Filed: Jun. 20, 2002

(65) Prior Publication Data

US 2003/0071560 A1 Apr. 17, 2003

(30) Foreign Application Priority Data

Oct. 16, 2001 (JP) ..... 2001-317581

(51) Int. Cl.[7] ..... H01J 63/04

(52) U.S. Cl. ..... 313/486; 313/495; 313/496; 252/301.4 R

(58) Field of Search ..... 313/486, 468, 313/485, 495, 496, 467, 487; 252/301.4 F, 301.4 R, 301.5

(56) References Cited

U.S. PATENT DOCUMENTS 5,644,193 A * 7/1997 Matsuda et al. ..... 313/486
6,163,108 A * 12/2000 Toki et al. ..... 313/496
6,280,656 B1 * 8/2001 O'Rourke et al. .... 252/301.4 F
6,653,777 B1 * 11/2003 Onishi ..... 313/495
2002/0145383 A1 * 10/2002 Tanabe et al. ..... 313/509
2003/0094889 A1 * 5/2003 Imamura et al. ..... 313/486

FOREIGN PATENT DOCUMENTS

| | | |
|---|---|---|
| JP | 7-245062 | 9/1995 |
| JP | 9-87618 | 3/1997 |
| JP | 2000-96046 | 4/2000 |

* cited by examiner

*Primary Examiner*—Jimmy T. Vu
(74) *Attorney, Agent, or Firm*—Miles & Stockbridge P.C.

(57) ABSTRACT

A field-emission display apparatus includes a faceplate on which a phosphor layer is formed, and a means for irradiating electron beam onto the phosphor layer and the phosphor layer is constituted by phosphors formed by mixing main phosphors with small particle phosphors, the averaged particle diameter of which is smaller than ½ of an averaged particle diameter of the main phosphors, enhancing the filing density of the phosphor layer and also enhancing both a lifetime characteristic and a luminescent characteristic of the phosphor layer.

27 Claims, 15 Drawing Sheets

DISPLAY

BACKGROUND OF THE INVENTION

The present invention relates to a field-emission type display and a projection tube, which are equipped with a faceplate where a phosphor layer is formed, and means for irradiating electron beams to the phosphor layer. The present invention more specifically relates to such a field-emission display (hereinafter, referred to as an "FED") and such a projection tube, into which small particle phosphors have been mixed, which constitutes the phosphor layer.

In picture information systems, various sorts of display apparatus have been positively researched and/or developed in order to satisfy various requirements, for example, high resolution, large screen sizes, thin type displays, and low power consumption. Display apparatus with employment of Braun tubes have been widely utilized in present fields. However, there are limitations in requirements as to thin type Braun tubes. To realize such thin type displays and low power consumption, FED has been very recently researched/developed in order to satisfy these requirements.

FED has a structure such that a plane-shaped field-emission type electron source is mounted on a rear plane of enclosed a vacuum box, and phosphor layers are provided on inner surfaces of faceplates of front planes thereof. In the FED, while an electron beam of low accelerating voltage (on the order of approximately 0.1 to 10 kV) are irradiated to the phosphor layers so as to emit light therefrom, an image is displayed on the FED. In this case, since electron density of the electron beam irradiated to the phosphor layer is approximately 10 to 1000 times higher than the electron density of the general-purpose Braun tube, namely high electron density, low resistance characteristics are required for the phosphor layer used in the FED, under which the phosphor layers are not saturated with electric charges. Furthermore, better lifetime characteristics under high electron density are required, and also, high luminescent characteristics with less luminescent saturation are required.

Also, there is another problem. That is, since the electron beam is irradiated onto the phosphor layer in high electron density, the electron beam may pass through the phosphor layer and then may be reached to an inner plane of faceplate, which may induce browning glass to change colors of the glass into brown colors. As a result, luminescent lifetimes of displays are lowered. Also, this browning glass phenomenon may constitute one of factors capable of lowering luminescent lifetime as to the projection tube. Generally speaking, in such a projection tube, the electron beam irradiated onto a phosphor layer in high electron density, which is approximately 100 times higher than that of a general-purpose Braun tube. This luminescent lifetime aspect of the projection tube should be solved.

Various development has been so far carried out in order to realize low resistance characteristics of phosphor layers, long lifetime characteristics thereof, and high luminescent characteristics thereof. As a method capable of improving performance of the phosphor layers used for FED by mixing the phosphors with the phosphor layers, for instance, JP-A-9-87618 describes such a method that since the high resistance phosphors are mixed with the low resistance phosphors, the superior luminescence characteristics may be owned under such a drive voltage lower than, or equal to 2 kV. Also, for example, JP-A-12-96046 discloses such a method that while the mixed phosphors are constituted by both the sulfur-system phosphors, and the oxide-system phosphors corresponding to either the aluminum oxide system of yttrium or the silicate system, the luminescent maintenance factor may be kept better over a long time duration.

On the other hand, although not being used in FED fields, as a method of mixing phosphors having different particle diameters with each other, JP-A-7-245062 describes the following method. That is, in the plasma display apparatus, the unnecessary discharge which is caused by exposing the address electrode may be suppressed by the phosphor layer having the fine structure in which the blue-color phosphors having the small particles are entered into the blue-color phosphors having the large particles.

Various sorts of methods have been studied in order to realize the low resistance, the long lifetime, and the high luminescence as to the phosphor layers used in FED. However, these conventional methods could not solve all of these problems. More specifically, such a novel method is necessarily required, by which not only resistances of the respective phosphors, but also the resistance of the entire phosphor can be lowered. Also, this novel method can realize the long lifetime as well as the high luminescence of the phosphor layers, and further, can mitigate the browning glass phenomenon.

SUMMARY OF THE INVENTION

As a consequence, an object of the present invention is to improve the respective low resistance characteristics, lifetime characteristics, and also luminescent characteristics of the above-explained conventional phosphor layer, and furthermore, is to provide both a field-emission display and a projection tube, which may have superior characteristics by reducing browning glass.

The above-described object may be achieved by that in a field-emission display equipped with a faceplate on which a phosphor layer is formed, and means for irradiating electron beam onto the phosphor layer, an image display apparatus is featured by that the phosphor layer is constituted by phosphors formed by mixing main phosphors with small particle phosphors, the averaged particle diameter of which is smaller than ½ of an averaged particle diameter of the main phosphors. In other words, one of the features of the phosphor layers used in the image display apparatus is given as follows. That is, since the small particle phosphors are mixed with the main phosphors, the small particle phosphors are entered into the spaces of the main phosphors, and the contacts occurred among the phosphors are increased, so that the lower resistance of the entire phosphor layer can be realized.

Also, in the case that an average particle diameter "B" of small particle phosphors is expressed by $0.16A \leqq B \leqq 0.28A$, which are mixed with main phosphors having an averaged particle diameter "A", the small particle phosphors are just entered into the spaces of the main phosphors, so that the filling density of the phosphor layer may be improved. Furthermore, in the case that the small particle phosphors are mixed with respect to the main phosphors in 2 weight % to 50 weight %, the small particle phosphors are entered into the spaces of the main phosphors, so that the filling density of the phosphor layer may be improved.

Also, when the phosphor layer is constituted by phosphors formed by mixing main phosphors, the averaged particle diameter of which is expressed by "A", with small particle phosphors, in such a case that the averaged particle diameter of which is expressed by "B", a volume of a position of the averaged particle diameter "B" is larger than a normal distribution curve by 2 weight % to 50 weight %, and the small particle phosphors are entered into the spaces of the main phosphors, so that the filling density of the phosphors layer can be improved. Furthermore, in the case that a volume of a position of the averaged particle diameter "B" is larger than the normal distribution curve by 6 weight % to 12 weight %, the filling density of the phosphor layer can be furthermore improved.

Also, since components of the main phosphors are identical to components of the small particle phosphors mixed with the main phosphors, the low resistance of the phosphor layer can be realized without changing the light emitting characteristic of the phosphors.

Also, since the main phosphors are ZnS:Ag phosphors corresponding to sulfur-system phosphors, and the phosphors to be mixed thereto are any one sort, or plural sorts of the below-mentioned phosphors: $Y_2SiO_5$ Ce, $(Y,Gd)_2SiO_5$; Ce, $ZnGa_2O_4$, CaMg $Si_2O_6$:Eu, $Sr_3MgSi_2O_8$:Eu, $Sr_5(PO_4)_3$ Cl:Eu, $YNbO_4$; Bi, corresponding to oxide-system phosphors, scattering of sulfur can be reduced. While the resistance of the phosphor larger can be lowered, the lifetime characteristic and the luminescent characteristic can be improved, so that the better blue-color phosphor layer used in the FED can be realized.

Also, since the main phosphors are $Y_2O_2S$:Eu phosphors corresponding to sulfur-system phosphors, and the phosphors to be mixed thereto are any one sort, or plural sorts of the below-mentioned phosphors: $Y_2O_3$ Eu, $SrTiO_3$:Pr, $SnO_2$:Eu, $SrIn_2O_4$:Pr, corresponding to oxide-system phosphors, scattering of sulfur can be reduced. While the resistance of the phosphor layer can be lowered, the lifetime characteristic and the luminescent characteristic can be improved, so that the better red-color phosphor layer used in the FED can be realized.

Also, since the main phosphors are any one sort, or plural sorts of the below-mentioned phosphors: $Y_2SiO_5$:Tb, $(Y,Gd)_2SiO_5$:Tb, $Y_3(Al,Ga)_5O_{12}$; Tb, $(Y,Gd)_3(A,Ga)_5O_{12}$; Tb, $ZnGa_2O_4$:Mn, $Zn(Ga,Al)_2O_4$:Mn, ZnO:Zn, corresponding to oxide-system phosphors, and also the small particle phosphors mixed with the main phosphors are any one sort, or plural sorts of the below-mentioned phosphors: ZnS:Cu, ZnS:Cu,Au, corresponding to sulfur-system phosphors, the contacts occurred among the respective phosphors are increased. While the resistance of the phosphor layer can be lowered, the lifetime characteristic and the luminescent characteristic can be improved, so that the better-green-color phosphor layer used in the FED can be realized.

Also, since the main phosphors are any one sort, or plural sorts of the below-mentioned phosphors: $Y_2O_3$:Eu, $SrTiO_3$:Pr, corresponding to oxide-system phosphors and also the small particle phosphors mixed with the main phosphors are $Y_2O_2S$:Eu phosphors, corresponding to sulfur-system phosphors, the contacts occurred among the respective phosphors are increased. As a result, while the resistance of the phosphors layer can be lowered, the lifetime characteristic and the luminescent characteristic can be improved, so that the better red-color phosphor layer used in the FED can be realized. Furthermore, the above-described object may be achieved by such a projection tube. That is, in a projection tube equipped with a faceplate on which a phosphor layer is formed, and means for irradiating electron beams onto the phosphor layer, the projection tube is provided with such a phosphor layer in which the phosphor layer is formed by mixing small particle phosphors into main phosphors in a range larger than, or equal to 5 weight %, and also smaller than, or equal to 70 weight %, while an averaged particle diameter of the small particle phosphors is small with respect to the main phosphors. In other words, as one of the features of the phosphor layer employed in the image display apparatus according to the present invention, since the small particle phosphors are mixed with the main phosphors, the small particle phosphors are entered into the spaces of the main phosphors, so that the filling density of the phosphor layer can be improved.

Also, since the small particle phosphors are entered into the spaces of the main phosphors, the contacts occurred among the phosphors are increased, so that the low resistance of the entire phosphor layer can be realized.

Also, such a phosphor layer is employed, in which the phosphor layer is formed by mixing the small particle phosphors into the main phosphors in a range larger than, or equal to 10 weight %, and also smaller than, or equal to 40 weight %, while an averaged particle diameter of the small particle phosphors is small with respect to the main phosphors. As a result, the filling density of the phosphor layer can be improved.

Since the above-described phosphor layer having such features is employed, while the browning glass caused by the irradiation of the electron beams which have passed through the inner plane of the faceplate can be improved in the projection tube and the field-emission type display, the image display apparatus having the better luminescent lifetime can be provided.

Other objects, features and advantages of the invention will become apparent from the following description of the embodiments of the invention taken in conjunction with the accompanying drawings.

DESCRIPTION OF THE EMBODIMENTS

It should be understood that while both a method for manufacturing a phosphor used in an image display apparatus of the present invention, and various characteristics such as luminescent characteristics will be described in detail, the below-mentioned embodiments merely indicate one example capable of embodying the present invention, but never restricts the present invention.

(Embodiment 1)

Figure 1:
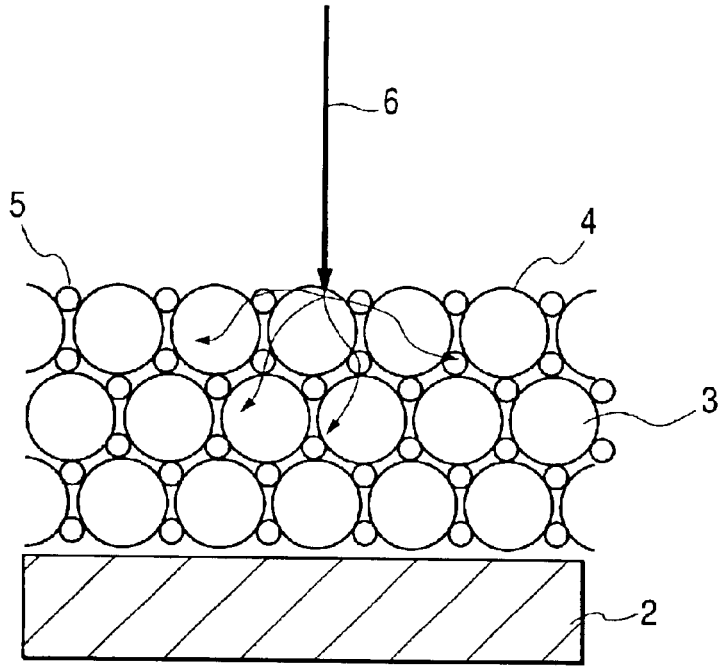
FIG. 1 is a schematic diagram for representing a phosphor layer structure of the present invention.

FIG. 1 is a schematic diagram for indicating one example of a phosphor layer according to the present invention. In FIG. 1, reference numeral 2 shows a faceplate, reference numeral 3 indicates an entire phosphor layer, reference numeral 4 represents a main phosphor, and reference number 5 indicates a small particle phosphor which is mixed into the phosphor layer. While a thickness of an optimum phosphor layer is nearly equal to three layers, the phosphor layer of the present invention owns such a structure that the small particle phosphor has been entered into spaces among the respective phosphor layers. Electrons produced by electron beams 6 which are received by the phosphor layer 3 are broadened over the entire portion of the phosphor layer 3 in a smooth manner, since contacts among the respective phosphor are increased by the mixed small particle phosphor 5. As a result, a low resistance of the entire portion of the phosphor layer 3 can be realized. Furthermore, the phosphor layer density can be improved by a total amount of the small particle phosphors mixed with this phosphor layer, and a surface area of the overall phosphor is increased.

As a consequence, electron density of the surface of the phosphor in the case that electron beam having the same electron amount are irradiated onto the phosphor layer is lowered in the present invention, as compared with that of the conventional technique. Since the electron density is lowered, temporal deteriorations (aging) of the phosphor layer may be mitigated, and the lifetime characteristic thereof may be improved. Also, when the electron density is lowered, lowering of luminescence caused by luminescence saturation can be suppressed, and light emitting luminescence of the entire phosphor layer can be improved.

In the case that sulfur-system phosphors are used as a peripheral structure of the phosphor layer, scattering of sulfur is prevented by an aluminum back, so that deteriorations of the electron source can be suppressed. Also, since an ITO film is provided on the side of the phosphor layer of the faceplate 2, low resistances of the phosphor layer can be improved.

As to the electron beams 6 received by the phosphor layer 3, while an accelerating voltage in a field-emission type display is selected to be approximately 0.1 kV up to approximately 10 kV, an electron amount of this field-emission type display is approximately 10 times through 1000 times higher than an electron amount of a general-purpose Braun tube. Also, an electron amount of irradiated electron beams in a projection tube is approximately 100 times higher than that of the general-purpose Braun tube. As a result, an amount of electron beam which penetrates through the phosphor layer and then is reached to the faceplate 2 becomes relatively large, and thus, browning glass occurs in which the inner surface of the faceplate 2 is colored in a brown color by the electron beam. When the browning glass happens to occur, light emitted in the phosphor passes through the faceplate 2, and then, intensity of such light which is projected from a front surface of the display is lowered. The browning glass may constitute one of reasons which may lower luminescent lifetime of the display. In order to mitigate the browning glass which may induce lowering of such luminescent lifetime of the display, there is such an effective way that filling density of the phosphor layer is increased so as to reduce the spaces existing among the phosphor, and the amount of penetrated electrons is reduced.

Since the phosphor layer into which the small particle phosphor has been mixed according to the present invention is employed, the filling density of the phosphor layer can be increased and the amount of the transmitted electrons can be decreased, so that the browning glass can be mitigated.

(Embodiment 2)

Figure 2:
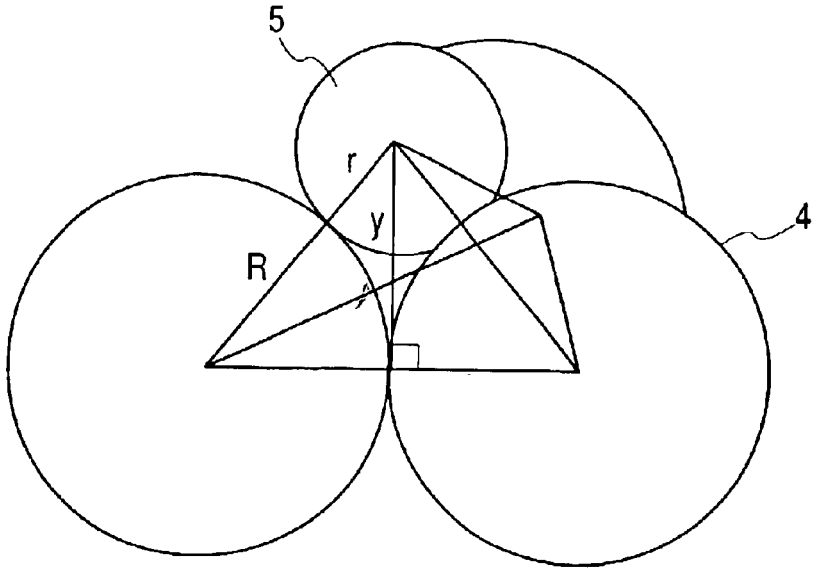
FIG. 2 is a schematic diagram for indicating a particle diameter of the phosphor layer according to the present invention.

FIG. 2 is a schematic diagram for indicating a portion of the above-described phosphor layer 3. In FIG. 2, the small particle phosphor 5 rides on three pieces of the main phosphors 4. Assuming now that a radius of the above-described main phosphor 4 is "R", a radius of the above-explained small particle phosphor 5 is "r", and a length of a line is selected to be "y", which is vertically drawn from a center of this small particle phosphor 5 to a plane which passes through a center of the main phosphor 4, this line length "y" is expressed by the following equation:

$$y=(r^2+2rR-\tfrac{1}{3}R^2)^{1/2}$$

When the line length "y" is equal to "0", namely, in the case that the small particle phosphor 5 is entered into spaces of the three main phosphors, the radius of this small particle phosphor 5 is given as follows:

$$r=0.16\,R.$$

Also, in a case that the small particle phosphor 5 is entered into a space formed when one piece of main phosphor is furthermore put on the above-explained three main phosphors 4, and then, is made in contact with all of the four main phosphors, the center of the small particle phosphor may become a center of gravity which is formed by the centers of the four main phosphors. As a consequence, $y=(8/27)R$, and $r=0.28$ R. Accordingly, assuming now that an average particle diameter of the main phosphors is "A", and an average particle diameter of the small particle phosphors to be mixed is "B", when the small particle phosphors are entered into the spaces of the main phosphors and then are made in contact with the respective phosphors, $0.16A \leqq B \leqq 0.28A$.

At this time, if the components of the small particle phosphors are identical to the components of the main phosphors, then the weight of the small particle phosphors to be mixed is preferably selected to be within a range between 2 weight % and 9 weight %.

Also, at this time, an increased portion of surface areas of the main phosphors caused by the small particle phosphors is equal to 10 to 31%. If the averaged particle diameter "B" of the small particle phosphors is equal to 0.28A, then the weight of the small particle phosphors to be mixed is 9 weight %, and the increased portion of the surface areas is equal to 31%. As a result, the electron density in such a case that the averaged particle diameter "B" of the small particle phosphors is equal to 0.28A is decreased by 24%.

Figure 3:
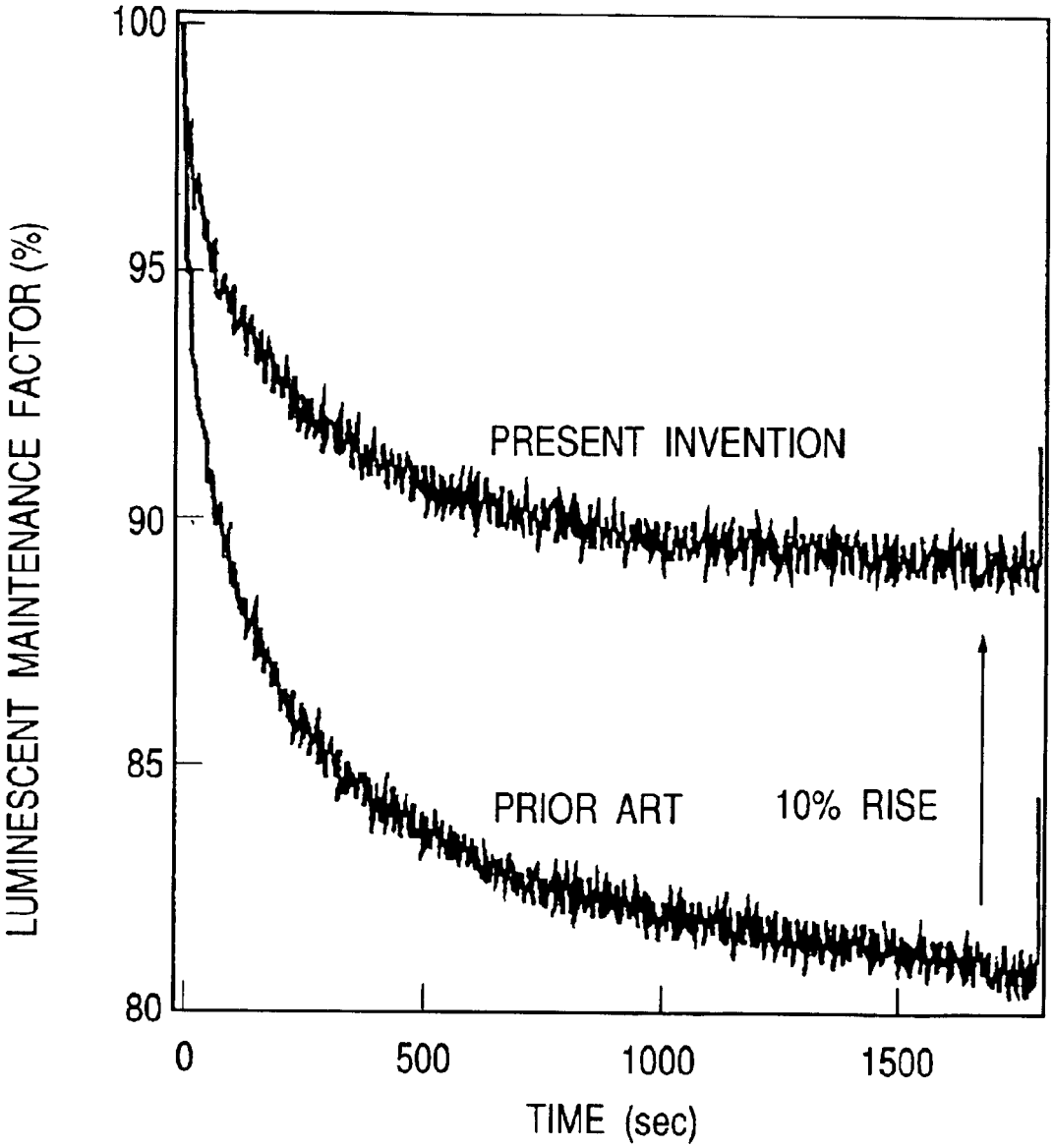
FIG. 3 is a graph for graphically representing a luminescent maintenance factor of the phosphor layer according to the present invention.

FIG. 3 indicates a luminescent maintenance factor by an acceleration test of a blue color (ZnS:Ag) phosphor in the case of B=0.28A. The electron density of irradiated electron beam is 450 $\mu$A/cm$^2$, and a temperature of a substrate is 200° C. In the conventional phosphor layer, when the electron beam is irradiated onto this conventional phosphor layer, luminescence thereof is rapidly lowered, and then, is decreased up to approximately 80%, as compared with the initial luminescence thereof. On the other hand, in the case that the phosphor layer according to the present invention is employed, a low resistance of the entire phosphor layer may be realized, and current density may be reduced. As a consequence, a luminescent maintenance factor of this phosphor layer is maintained at approximately 90% when the acceleration test is accomplished. As previously explained, since the phosphor layer of the present invention is employed, the luminescent maintenance factor thereof may be improved by approximately 10%, as compared with that of the conventional technique.

Figure 4:
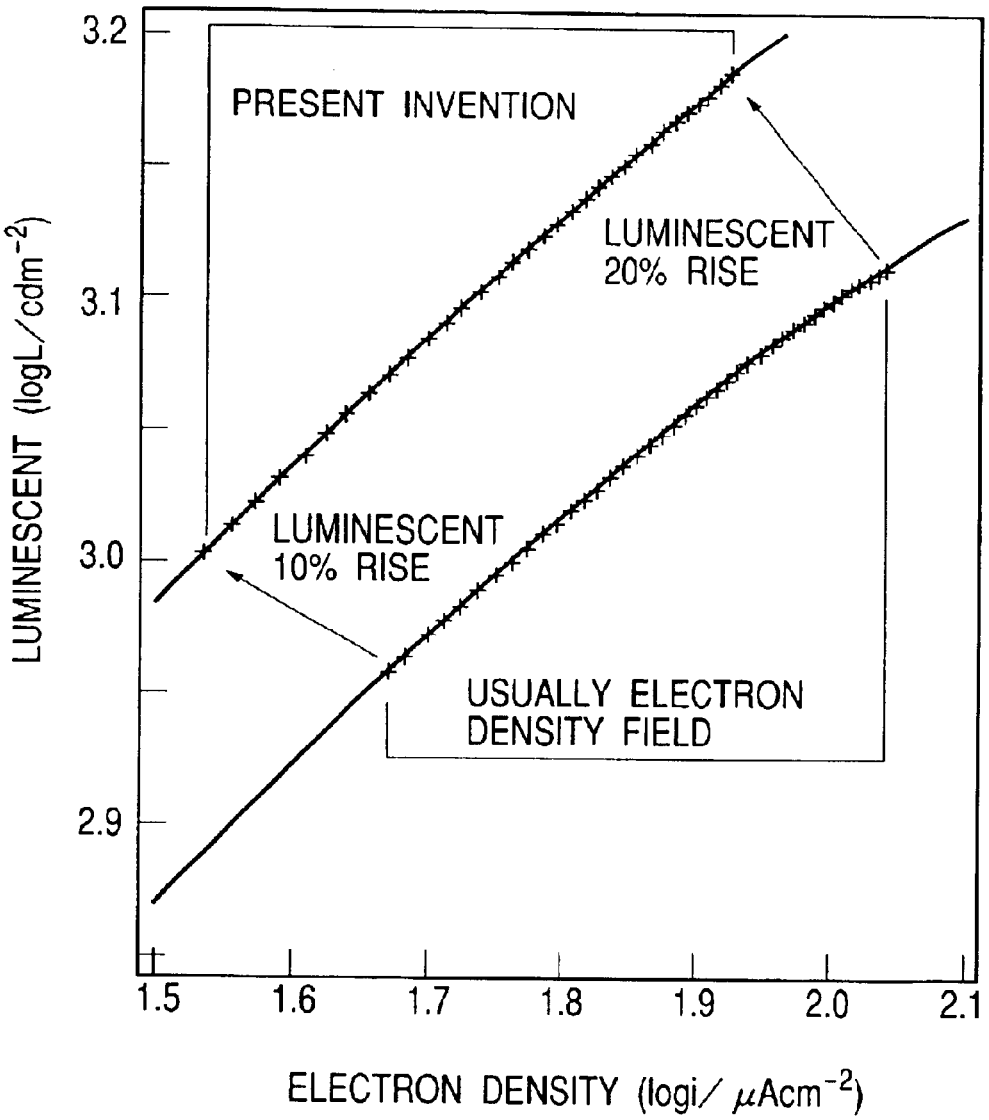
FIG. 4 is a graph for graphically showing a luminescence/electron density characteristic of the phosphor layer according to the present invention.

FIG. 4 is a graph for graphically indicating both light emitting luminance and electron density of a blue color (ZnS:Ag) phosphor, which are plotted in a logarithm scale. A range of the electron density is selected to be approximately 45 $\mu$A/cm$^2$ in a low electron density field, and selected to be approximately 110 $\mu$A/cm$^2$ in a high electron density field. A lower line of this graph corresponds to a graph for showing light emitting luminescence/electron density of conventional technique, whereas an upper line of this graph corresponds to a graph for indicating light emitting luminescence/electron density of the present invention.

As previously explained, the electron density in the case of B=0.28A is decreased by approximately 24%, and this electron density becomes nearly equal to 35 $\mu$A/cm$^2$ in the low electron density field, and becomes nearly equal to 85 $\mu$A/cm$^2$ in the high electron density field. In the case of the ZnS:Ag phosphor, an inclination of the log—log plot is lowered from approximately 0.7 to 0.6 in accordance with an increase in the electron density, so that a luminescence efficiency is lowered. As a result, when the electron density becomes low, the luminescence efficiency becomes high.

In accordance with the present invention, since the electron density is lowered and thus the field of the high luminescence efficiency can be utilized, as indicated in FIG. 4, the light emitting luminescence could be improved by approximately 10% in the low electron density field, and also, could be improved by approximately 20% in the high electron density field.

(Embodiment 3)

Figure 5:
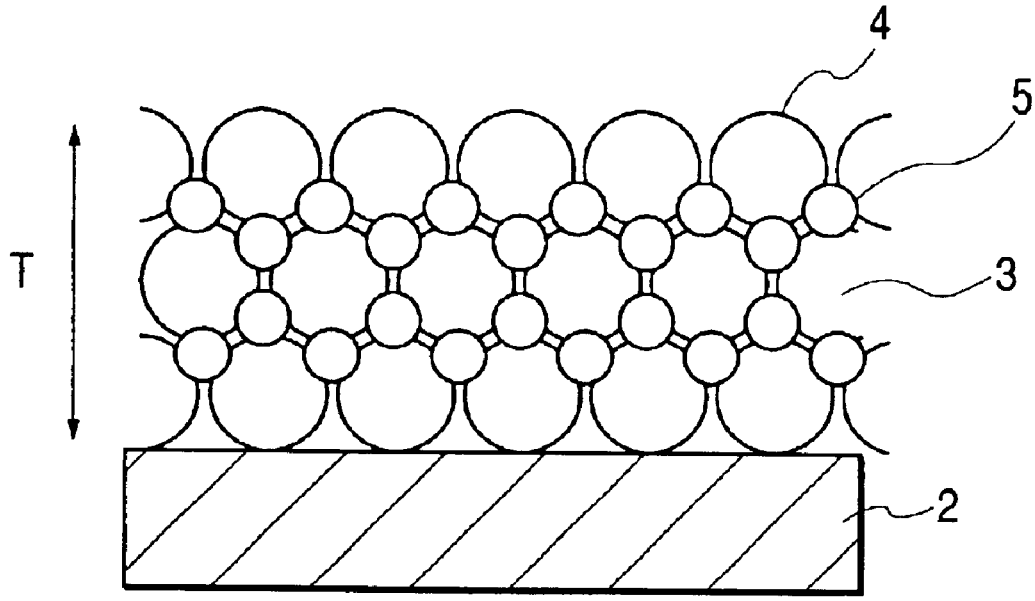
FIG. 5 is a schematic diagram for indicating a phosphor layer structure according to the present invention.
Figure 6:
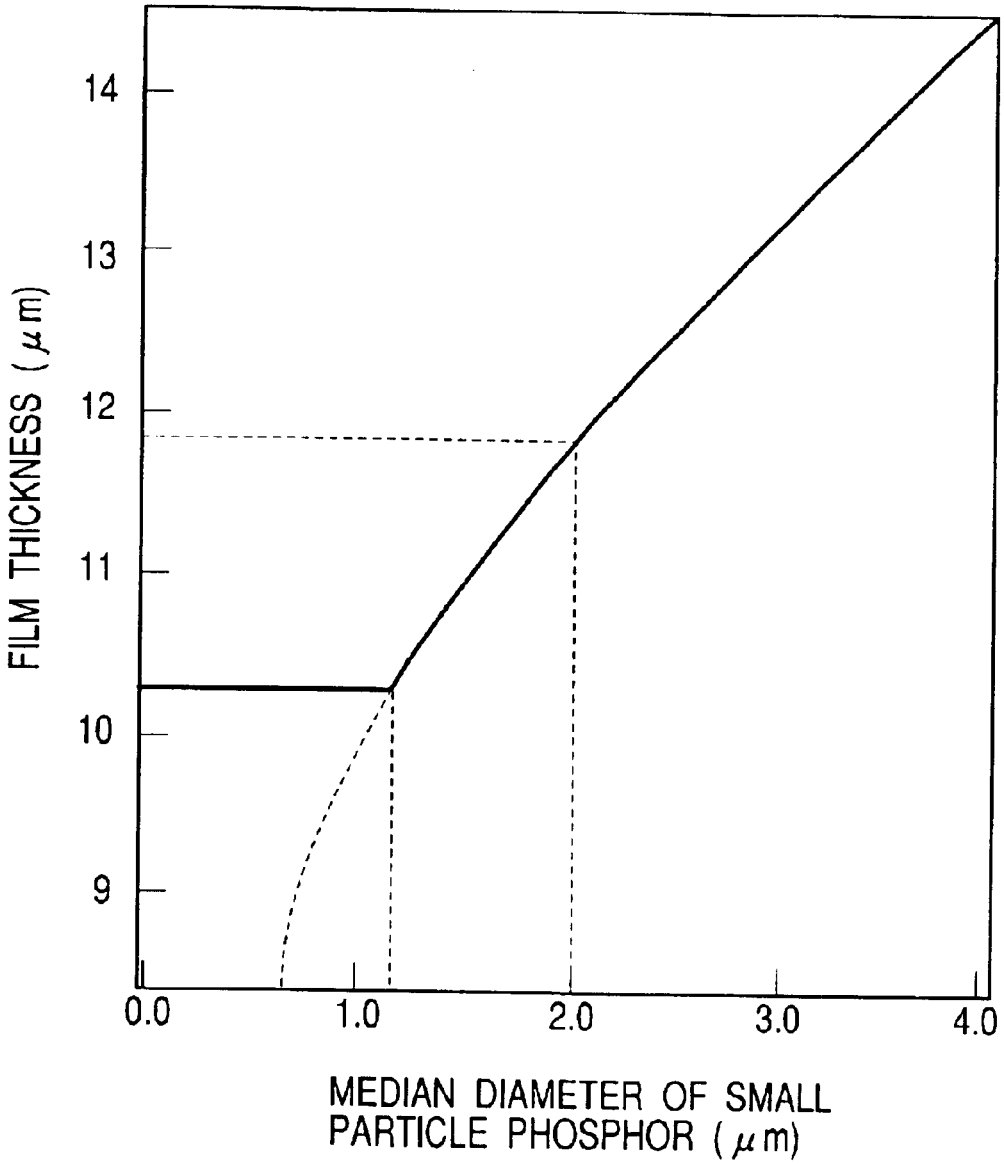
FIG. 6 is a graph for graphically showing a film thickness of the phosphor layer according to the present invention.

FIG. 5 is a schematic diagram for schematically indicating such a case of B>0.28A, namely, the averaged particle radius "B" of the small particle phosphors 5 to be mixed is larger than the space of the main phosphors 4. A film thickness "T" of a phosphor layer may be expressed by T=4R+2y. FIG. 6 is a graph for graphically showing a change in film thicknesses caused by a change in averaged particle diameters of small particle phosphors in the case that an averaged particle diameter of main phosphors is equal to 4 $\mu$m. While the averaged particle diameter of the small particle phosphors is smaller than approximately 1.1 $\mu$m, since the small particle phosphors are entered into the spaces, the film thickness of the phosphor layer is not changed, namely, on the order of 10.5 $\mu$m.

On the other hand, as indicated in FIG. 6, in the case that B>1.1 $\mu$m, there is a trend that the film thickness becomes thick. As to a weight of small particle phosphors in the case that a composition of phosphors is identical to the composition of the small particle phosphors and the averaged particle diameter "B" of the small particle phosphors is equal to 1.1 $\mu$m, 9 weight % thereof is optimum. An optimum film thickness in the case that the averaged particle diameter of the main phosphors is equal to 4 $\mu$m is preferably selected to be approximately 10 to 12 $\mu$m, due to a requirement of the luminescence characteristic. If a film thickness is thinner than this optimum film thickness, then a film thickness of a light emitting layer is not sufficiently thick and luminescence becomes low. Conversely, if a film thickness of a light emitting layer becomes thicker than the optimum film thickness, then light emitting luminescence is lowered due to optical absorptions occurred on a surface of a phosphor. As indicated in FIG. 6, when the averaged particle diameter of the small particle phosphors is smaller than 2.0 $\mu$m which is a half of the averaged particle diameter of the main phosphors, the film thickness thereof is smaller than 12 $\mu$m, namely becomes better. At this time, a weight of phosphors to be mixed is desirably selected to be such a range smaller than 50 weight %, and density of phosphor layers is desirably selected to be 6 weight % to 12 weight %.

Figure 7:
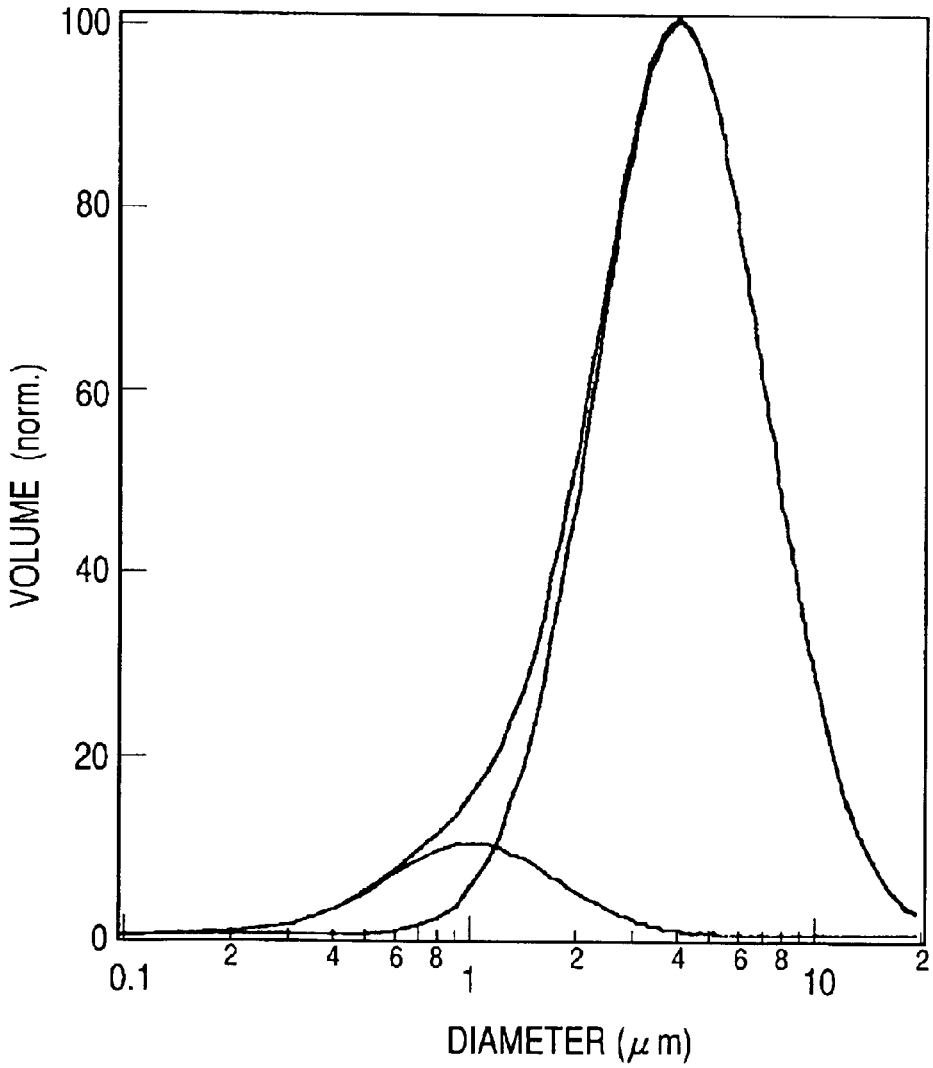
FIG. 7 is a graph for graphically indicating a particle (grain) size distribution according to the present invention.

FIG. 7 is a graph for graphically representing a particle distribution of phosphors. In FIG. 7, an ordinate shows a volume ratio, and an abscissa indicates a particle diameter of a phosphor. As represented in FIG. 7, in such a case that small particle phosphors, the averaged particle diameter of which is 1 $\mu$m, are mixed into main phosphors, the averaged particle diameter of which is 4 $\mu$m, in the ratio of 10 weight %, such an overall particle distribution which is shifted to the small particle side is obtained. This particle distribution is deviated from a normal distribution which is formed by the main phosphors by such an amount of the small particle phosphors mixed into these main phosphors. In the case that the component of the main phosphors is identical to the component of the small particle phosphors, this deviation is nearly equal to a weight ratio of the small particle phosphors to be mixed into the main phosphors, whereas deviation from a normal distribution of a volume ratio at a position of a particle diameter "B" may become better within a range larger than 2 volume % to 50 volume %, in particular, may become preferable within a range larger than 6 volume % to 12 volume %.

Figure 8:
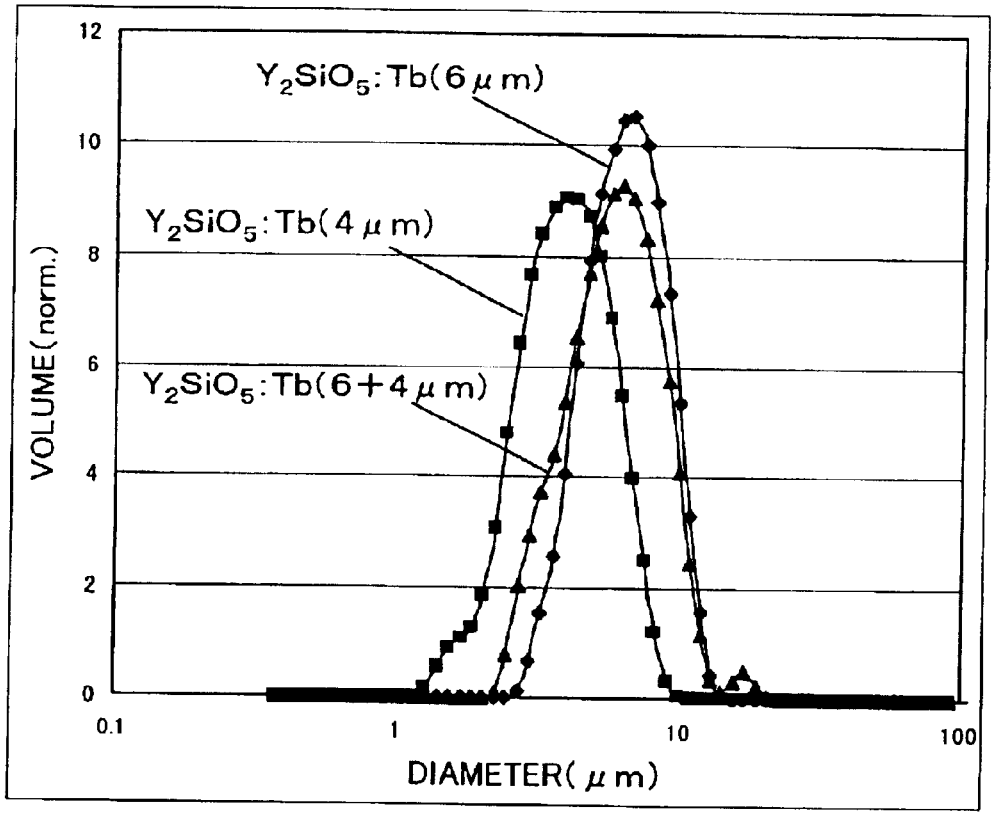
FIG. 8 is a graph for graphically indicating a particle size distribution (6+4 $\mu$m) according to the present invention.

FIG. 8 is a graph for graphically representing particle distributions of $Y_2SiO_5$;Tb that the averaged particle diameter of 6 $\mu$m and 4 $\mu$m, and the mixed phosphors with 6 $\mu$m and 4 $\mu$m phosphors. As represented in FIG. 8, the small particle phosphors of the averaged particle diameter of 4 $\mu$m are mixed into main phosphors of the averaged particle diameter of 6 $\mu$m in the ratio of 20 weight %. Then the overall particle distribution is shifted to the small particle side and the particle distribution of the mixed phosphors is deviated from the particle distribution of 6 $\mu$m phosphors.

Figure 9:
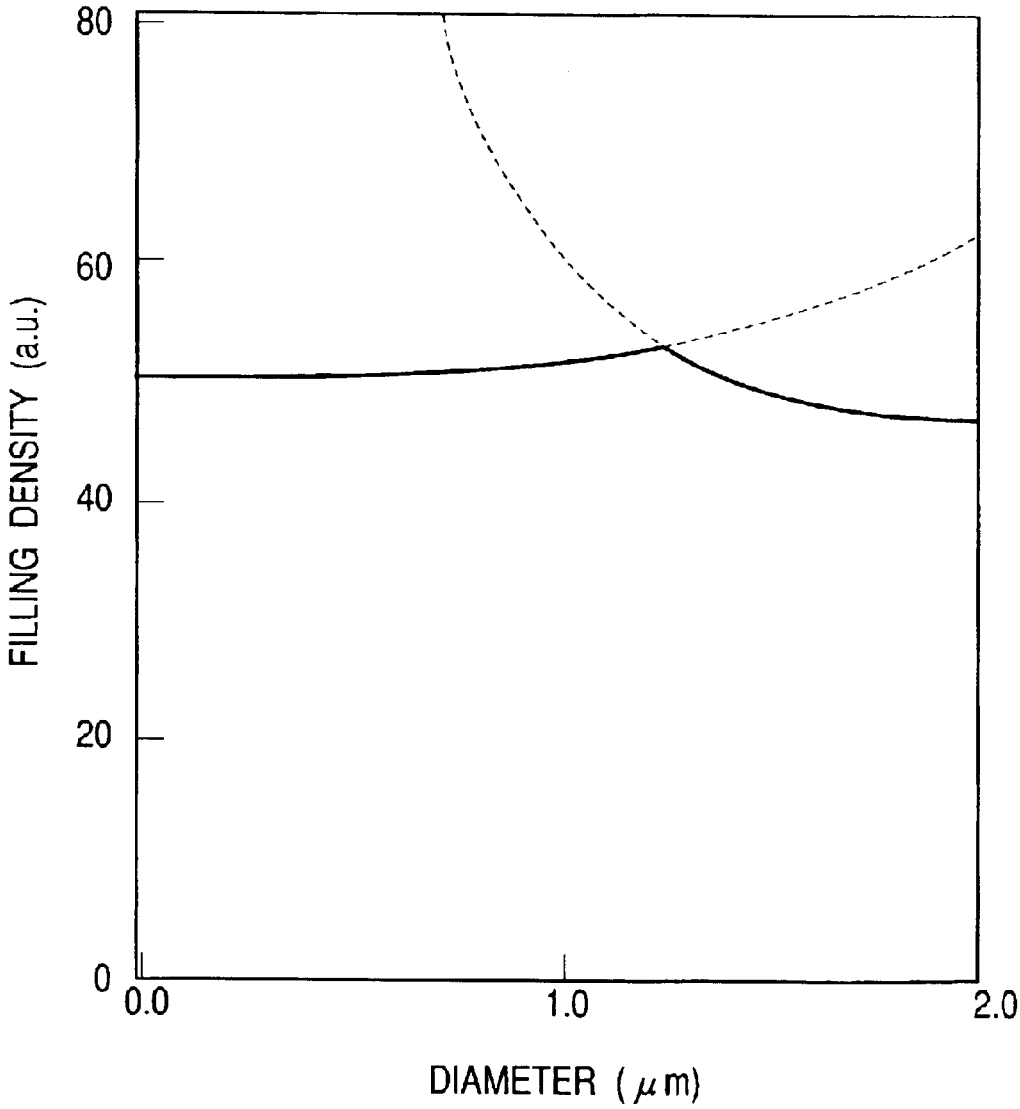
FIG. 9 is a graph for graphically showing phosphor layer filing density according to the present invention.

FIG. 9 graphically shows an averaged particle depending characteristic of small particle phosphors of phosphor layer filling density. The averaged particle diameter "B" of the small particle phosphors is preferably selected to be on the order of 0.8 to 1.4 $\mu$m. As a consequence, in such a case that the component of the main phosphors is identical to the component of the small particle phosphors, density of the phosphor layer is more desirably selected to be 6 weight % to 12 weight %.

(Embodiment 4)

In this embodiment, while a mixed phosphor layer was formed on a glass substrate as a principle experiment, a film thickens, film density, and also a characteristic of a transmittance rate as to this mixed phosphor layer were investigated. While green-light emitting ($Y_2SiO_5$:Tb) phosphors, the averaged particle diameter of which was 8 μm, were mixed with green-light emitting ($Y_2SiO_5$:Tb) phosphors, the averaged particle diameter of which was 4 μm, a phosphor layer was formed by way of a sedimentation method on the glass substrate. In the presently-executed sedimentation method, pure water of 135 ml was entered into a sedimentation tube having a diameter of 65 mm, and a solution of 14 ml made by adding anhydrous barium acetate of 1.30 g to pure water of 150 ml was entered into the sedimentation tube, and then, surfactant of 14 ml was added thereto. A mixed phosphor whose weight was measured in order to become a predetermined film thickness was added to pure water of 50 ml, to which such a solution of 27 ml was added, and then, the resultant solution was entered into the sedimentation tube to which both the solution and the substrate had been set. This solution was manufactured by adding water glass ("ohkaseal A" manufactured by TOKYO OHKA KOGYO) of 40 ml to pure water of 198 ml. When the sedimentation method is carried out, a height measured from the glass substrate up to the surface of the fluid is nearly equal to 5 cm. While the sedimentation time was selected to be 7 minutes, the solution was slowly extracted from the lower portion of the sedimentation tube after the sedimentation method had been carried out. Thereafter, the sedimentation-processed substrate was dried at a room temperature. The mixed phosphor layer was formed in the above-described manner.

Figure 10:
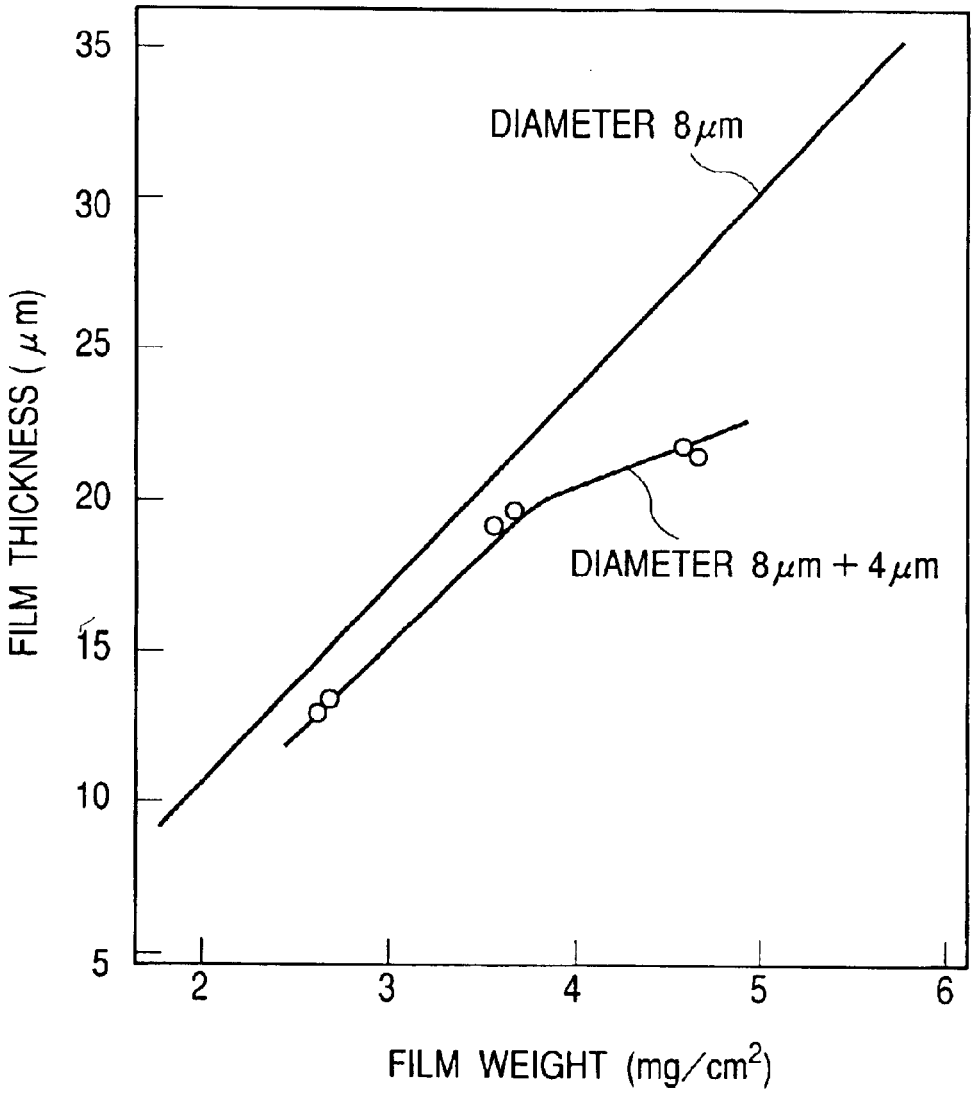
FIG. 10 is a graph for graphically showing a relationship between a film weight and a film thickness of the phosphor layer according to the present invention.

A film weight of the sedimentation-processed phosphor layer was calculated from weights of the glass substrate before/after the sedimentation method was carried out. Also, the film thickness was measured by using an instrument of laser focus displacement (LT-8010, KEYENCE). The film density was calculated based upon the film weight, the film thickness, and the substrate area. FIG. 10 shows a change in film weights of a film thickness of a sedimentation-processed phosphor layer. A film thickness of a single phosphor layer having a particle diameter of 8 μm is increased in a linear manner in connection with an increase of a film weight. A film thickness-to-film weight change of a mixed phosphor layer is further indicated in FIG. 10, while this mixed phosphor layer is formed by adding a phosphor having a particle diameter of 4 μm in 30 weight % to a phosphor having a particle diameter of 8 μm. As to the same film weights, the film thickness of the mixed phosphor film is made thinner. In particular, when the film weight exceeds 4 mg/cm$^2$, the film thickness of the mixed phosphor film may become largely thin.

Figure 11:
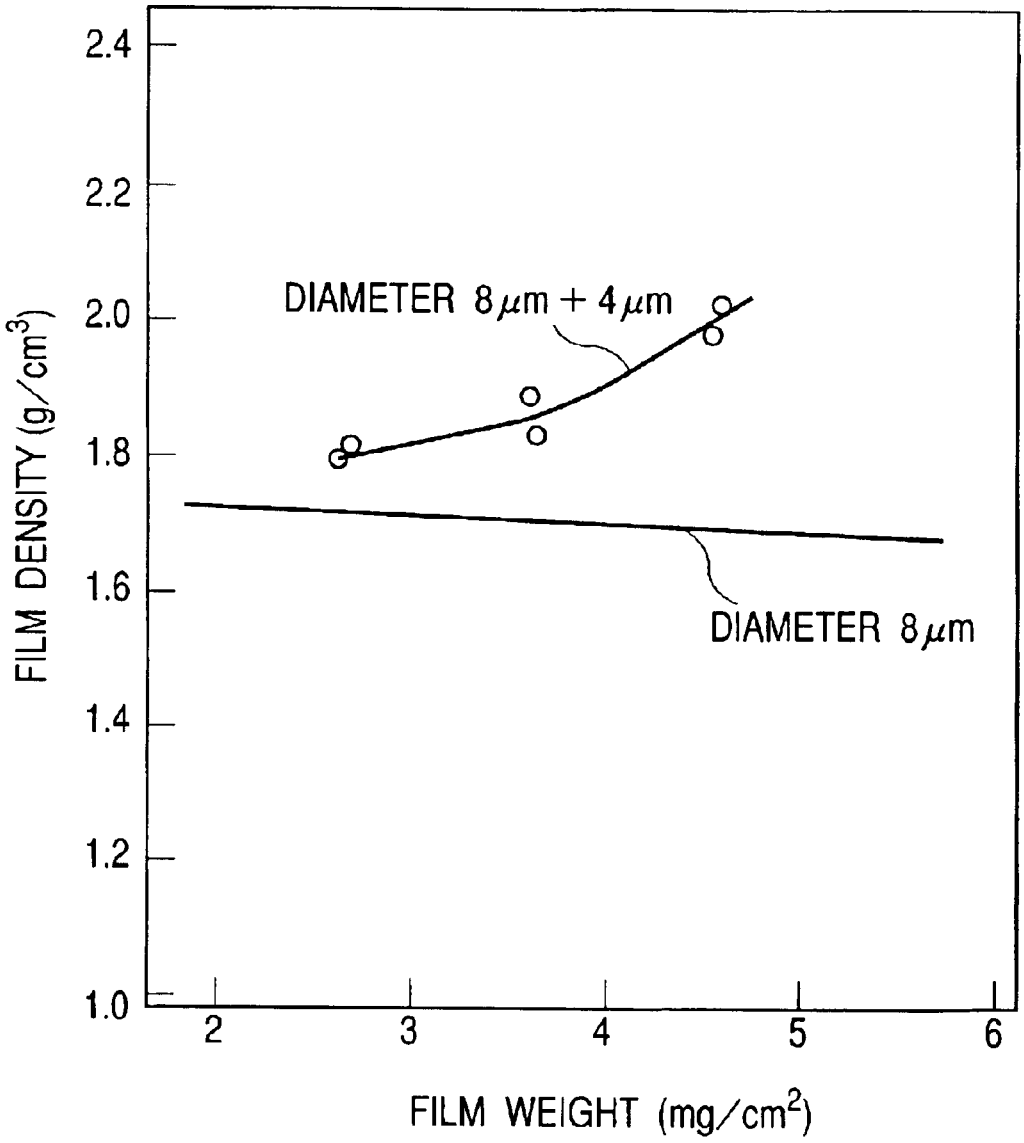
FIG. 11 is a graph for graphically indicating a relationship between film density and a film weight of the phosphor layer according to the present invention.

FIG. 11 graphically represents a change in film weights of film density. In the case of a single phosphor layer, film density becomes substratially constant, namely approximately 1.7 g/cm$^3$, irrespective of a film weight thereof. In the case of a mixed phosphor layer, there is such a trend that a film weight of this mixed phosphor layer is increased, and film density thereof is increased. When the single phosphor layer is compared with the mixed phosphor layer, the film density of the mixed phosphor layer is higher than that of the single phosphor layer, and also, the larger the film weight becomes, the larger a difference thereof is increased.

Next, optical transmittance rates of the respective phosphor layers were measured by employing a spectrometer (V-3200 marketed by HITACHI Co., Ltd.). While a wavelength of light to be irradiated was selected to be 540 nm, the light was irradiated from the phosphor layer side, and then, an amount of light which had passed through both the phosphor layer and the substrate glass was measured. As a reference, only the glass substrate was set, and then, an optical transmittance rate of the phosphor rate was measured.

Figure 12:
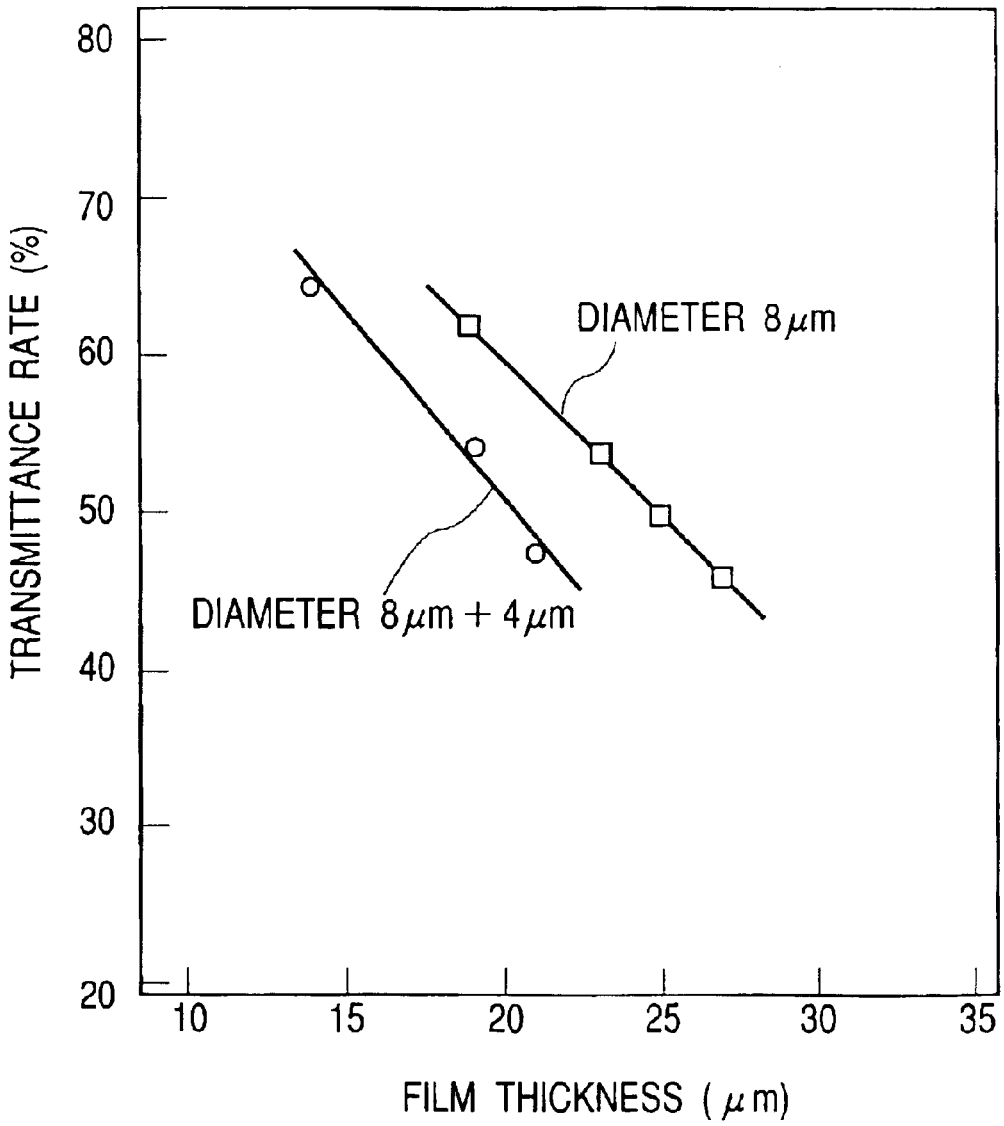
FIG. 12 is a graph for graphically showing an optical transmittance rate-to-film thickness characteristic according to the present invention.

FIG. 12 graphically shows a film thickness change of optical transmission rates in the case of a single phosphor layer having a particle diameter of 8 μm, and also, represents a film thickness change of optical transmittance rates of such a mixed phosphor layer made by mixing a phosphor layer having a particle diameter of 4 μm in a phosphor layer having a particle diameter of 8 μm by 30 weight %. When film thickness of both the single phosphor film and the mixed phosphor film become thick, transmittance rates thereof are decreased. When the film thickness of the single phosphor layer is the same as the film thickness of the mixed phosphor layer, the optical transmittance rate of the mixed phosphor layer becomes lower than that of the single phosphor layer by approximately 10%.

A comparison was carried out as to film thicknesses, film density, and optical transmittance rates of such a phosphor having a particle diameter of 8 μm, and of such a mixed phosphor layer which was manufactured by mixing the phosphor having the particle diameter of 4 μm into the phosphor having the particle diameter of 8 μm by 30 weight %. The following fact could be revealed. That is, in the mixed phosphor layer, the film thickness was thin, and the film density was high. Also, the optical transmittance ratio of the mixed phosphor layer was largely lowered by approximately 10%. As previously described in the embodiment 1, these result may indicate that the mixed small particle phosphors were entered into the spaces among the main phosphors, so that the space rate was lowered.

(Embodiment 5)

While green-light emitting ($Y_2SiO_5$:Tb) phosphors having an averaged particle diameter of 8 μm were mixed with green-light emitting ($Y_2SiO_5$:Tb) phosphors having an averaged particle diameter of 4 μm, a phosphor layer was formed on a glass substrate by way of the sedimentation method. A method for forming the phosphor layer is similar to the forming method of the embodiment 4.

Figure 13:
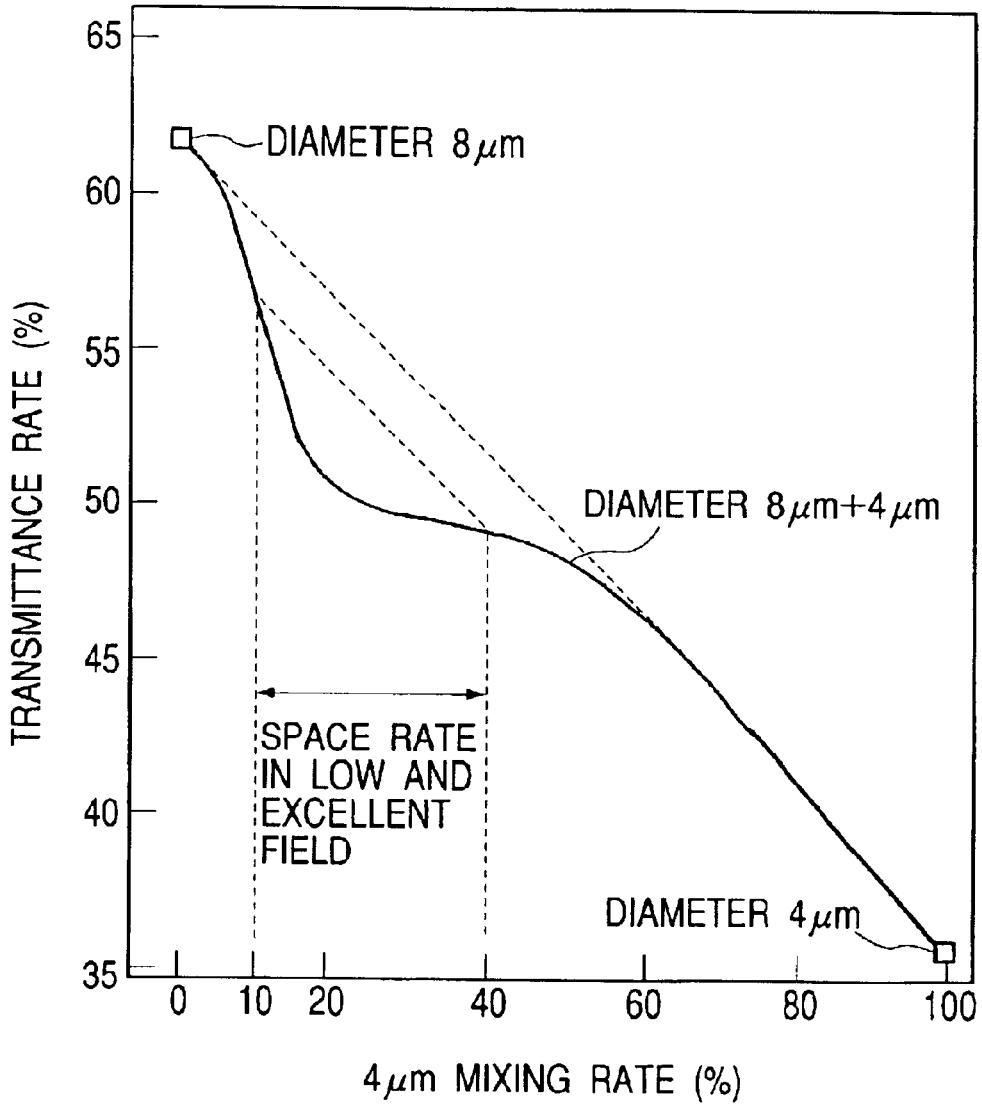
FIG. 13 is a graph for graphically indicating an optical transmittance rate-to-small particle mixing rate characteristic according to the present invention.

FIG. 13 graphically indicates a 4 μm mixing rate change of a light transmission rate of a phosphor layer. Since the transmittance rate of the particle diameter of 4 μm is low, there is such a trend that the entire transmittance rate is lowered in connection with an increase of the 4 μm mixing rate. A single phosphor layer made by small particle phosphors may be conceived as one of subjects capable of realizing a high density phosphor layer. In the case of such a small particle phosphor, there are some possibilities that both luminescence and a lifetime characteristic of this small particle phosphor are deteriorated, as compared with those of a large particle phosphor. In this embodiment, a description will now be made of such a fact that when a mixing rate of a small particle phosphor is low, high density of a phosphor layer can be realized. As apparent from FIG. 13, within a range that the small particle mixing rate is larger than, or equal to 5 weight % and smaller than, or equal to 70 weight %, there is such a range that a transmittance rate is further lowered, as compared with a linear descent curve of the transmittance rate. The transmittance rate of the single phosphor layer having the particle diameter of 8 μm is equal to 62%, whereas the transmittance rate of the mixed phosphor layer becomes 54%, namely is lowered by approximately 8% while the 4 μm mixing rate is equal to 10 weight %. The transmittance rate is low within such a range that the 4 μm mixing rate is larger than, or equal to 5 weight %, and is smaller than, or equal to 70 weight %. In the case that the mixing rate is relatively low, this effect may appear. In particular, within a range that the 4 μm mixing rate is larger than, or equal to 10 weight %, and is smaller than, or equal to 40 weight %, the transmittance rate is low, and also, a stopping effect of light which is caused by mixing small particle phosphors can become large. As apparent from this result, even when electron beams are irradiated to the mixed phosphor layer, the stopping effect with respect to the electron beams may be achieved, so that an occurrence of browning glass on an inner surface of a faceplate can be mitigated.

Next, a calculation of a space rate which corresponds to a rate of particles with respect to a space was carried out by executing a computer program for predicting a space rate of filling two particles (MICHITAKA SUZUKI).

Figure 14:
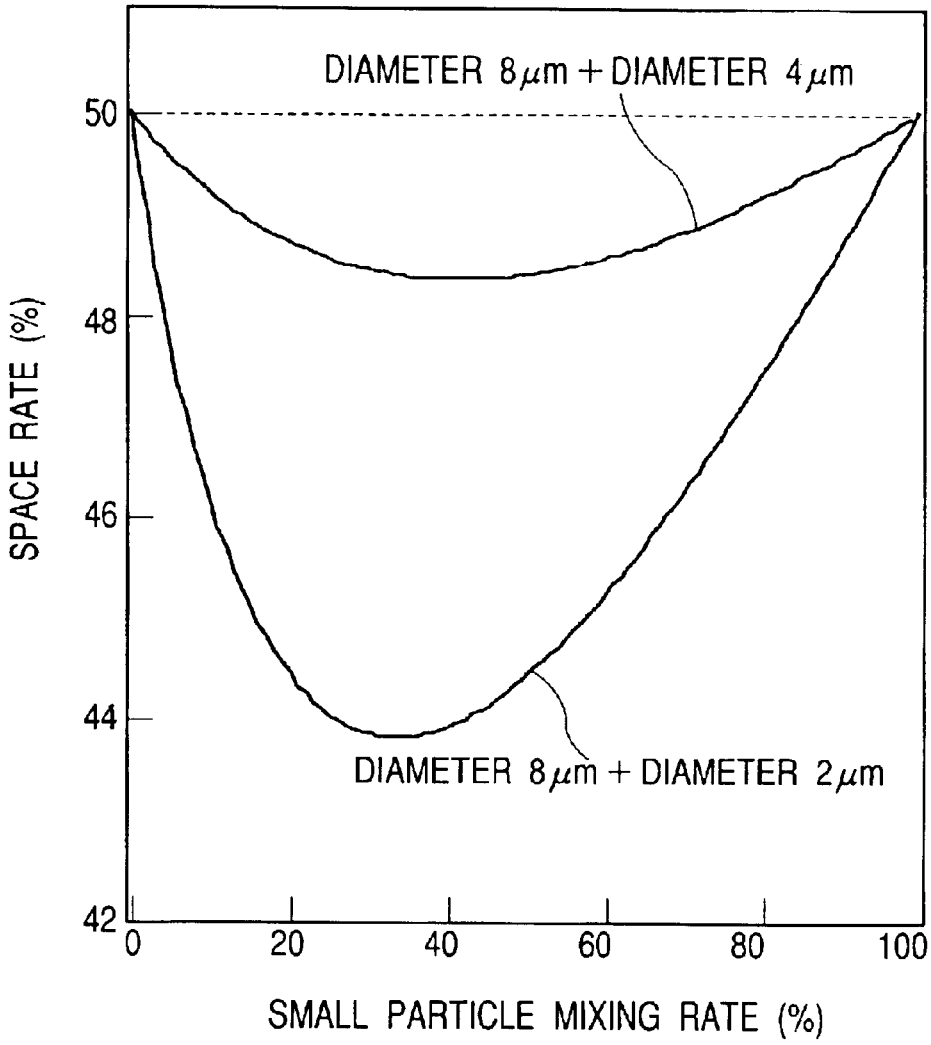
FIG. 14 is a graph for graphically representing a calculation result of a space rate-to-small particle mixing characteristic according to the present invention.

FIG. 14 graphically shows a small particle mixing rate change of a space rate obtained when a particle whose particle diameter is 8 μm and whose space rate is 50% is mixed with a particle whose particle diameter is 4 μm and whose space rate is 50%. It can be seen that the resulting space rate becomes lower than the space rate 50% of both the particles by mixing these two particles with each other. In the case that the small particle mixing rate is 41 weight %, the space rate becomes 48%, namely minimum. In addition to the above-described small particle mixing rate change of the space rate, FIG. 14 graphically shows another small particle mixing rate change of a space rate obtained when a particle whose particle diameter is 8 μm and whose space rate is 50% is mixed with a particle whose particle diameter is 2 μm and whose space rate is 50%. In the case that the particle having the particle diameter of 2 μm is mixed, when the small particle mixing rate is equal to 33 weight %, the space rate becomes 44%, namely minimum. When the case where the particle having the particle diameter of 4 μm is mixed with the particle having the particle diameter of 8 μm is compared with the case where the particle having the particle diameter of 2 μm is mixed with the particle having the particle diameter of 8 μm, it can be understood that the space rate is largely lowered in such a case that the particle having the particle diameter of 2 μm and the large particle difference is mixed with the particle having the particle diameter of 8 μm. Also, the small particle mixing rate where the space rate becomes minimum is decreased in such a case that the particle having the large particle having the large particle difference is mixed with the particle having the particle diameter of 8 μm.

A comparison was made between an experimental result and a calculation result in the case that the particle having the particle diameter of 4 μm was mixed with the particle having the particle diameter of 8 μm. That is, in the experiment, the transmittance rate was low within such a range that the small particle mixing rate is larger than, or equal to 10 weight %, and also, is smaller than, or equal to 40 weight %, while 20 weight % of this small particle mixing rate is located at a center. In the calculation, when the small particle mixing rate is 41 weight %, the space rate become minimum. Thus, there was such a field that the filling density became better and the mixing rate was low in the experiment. This reason is given as follows. That is, since each of the phosphors owns a spread in the particle distribution, the space rate lowering effect achieved by both the large particle contained in the particles having the particle diameter of 8 μm, and also the small particle contained in the particles having the particle diameter of 4 μm may become large. It is conceivable that the optimum point of the small particle mixing rate in the experiment may become lower than the optimum point in the calculation.

CONCRETE EXAMPLES

While the present invention will now be explained by citing the below-mentioned concrete examples, the present invention is not limited to these concrete examples, but may apparently involve substitutions and design changes of the respective structural elements within a range where the objects of the present invention may be achieved.

Concrete Example 1

MIM TYPE ELECTRON SOURCE DISPLAY—NO. 1

Figure 15:
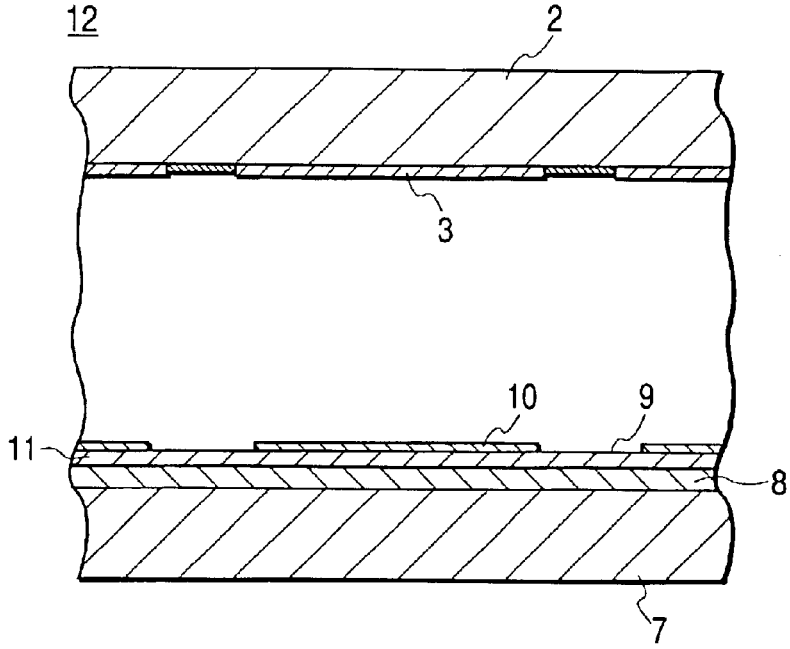
FIG. 15 is a schematic diagram for indicating an entire arrangement of a display equipped with an MIM type electron source according to the present invention.

A display equipped with an MIM type electron source according to the present invention is indicated in FIG. 15. The display 12 equipped with the MIM type electron source is arranged by a faceplate 2, an MIM type electron source 11, and a rear plate 7. The MIM type electron source 11 is constituted by a lower electrode (Al) 8, an insulating layer ($Al_2O_3$) 9, and also, an upper electrode (Ir—Pt—Au) 10. In particular, a phosphor layer 3 is provided on an inner surface of the faceplate 2, while this phosphor layer 3 is formed by mixing ZnS:Ag phosphors, the averaged particle diameter of which is 4 μm, with ZnS:Ag small particle phosphors, the averaged particle diameter of which is 1 μm, in 9 weight % as blue phosphors. Furthermore, in order to reduce a resistance of the phosphors, a conductive material $In_2O_3$ was mixed into the phosphor layer.

In order to increase high resolution, a black-color conductive material was provided between one pixel. While the black-color conductive material is manufactured, a photoresist film is coated over an entire surface, this entire surface is exposed via a mask and is developed, and then, the photoresist film is partially left. Thereafter, after a graphite film has been formed over the entire surface, a hydrogen peroxide is effected so as to remove the photoresist film and the graphite formed on this photoresist film, so that the black-color conductive material could be formed. A metal back is formed in such a manner that after the inner surface of the phosphor layer 3 has been filming-processed, aluminium (Al) is vapor-deposited on this filming-processed inner surface. Thereafter, a thermal process is carried out to take away the filming agent, so that the metal back could be formed. The phosphor layer 3 may be accomplished in the above-described manner.

In accordance with the present invention, the luminescent maintenance factor could be improved by 10%, as compared with that of the prior art, and the energy efficiency of the light emission could be improved by 10% in the low electron field, and by 20% in the high electron field.

Concrete Example 2

MIM TYPE ELECTRON SOURCE DISPLAY—NO. 2

A display equipped with an MIM type electron source according to the present invention is indicated in FIG. 15. In particular, a phosphor layer 3 is provided on an inner surface of the faceplate 2, while this phosphor layer 3 is formed by mixing ZnS:Ag phosphors, the averaged particle diameter of which is 4 μm, with $Y_2SiO_5$:Ce small particle phosphors, the averaged particle diameter of which is 1 μm, as blue phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 3

MIM TYPE ELECTRON SOURCE DISPLAY—NO. 3

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_2S$:Eu phosphors, the averaged particle diameter of which is 3 μm, with $Y_2O_2S$:Eu small particle phosphors, the averaged particle diameter of which is 0.8 μm, as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 4

MIM TYPE ELECTRON SOURCE DISPLAY—NO. 4

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_2S$: Eu phosphors, the averaged particle diameter of which is 2.5 μm, with $Y_2O_3S$:Eu small particle phosphors, the averaged particle diameter of which is 1 μm, as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 5

MIM TYPE ELECTRON SOURCE DISPLAY—NO. 5

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_2S$: Eu phosphors, the averaged particle diameter of which is 4 μm, with $SrTiO_3$:Pr small particle phosphors, the averaged particle diameter of which is 1 μm as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 6

MIM TYPE ELECTORN SOURCE DISPLAY—NO. 6

A display equipped with an MIM type electron source according to the present invention is indicated in FIG. 15. In particular, a phosphor layer 3 is provided on an inner surface of the faceplate 2, while this phosphor layer 3 is formed by mixing ZnS:Cu phosphors, the averaged particle diameter of which is 3 μm, with ZnS:Cu small particle phosphors, the averaged particle diameter of which is 0.8 μm as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 7

MIM TYPE ELECTORN SOURCE DISPLAY—NO. 7

A display equipped with an MIM type electron source according to the present invention is indicated in FIG. 15. In particular, a phosphor layer 3 is provided on an inner surface of the faceplate 2, while this phosphor layer 3 is formed by mixing ZnS:Cu phosphors, the averaged particle diameter of which is 3 μm, with $Y_2SiO_5$:Tb small particle phosphors, the averaged particle diameter of which is 0.8 μm as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 8

MIM TYPE ELECTRON SOURCE DISPLAY—NO. 8

A display equipped with an MIM type electron source according to the present invention is indicated in FIG. 14. In particular, a phosphor layer 3 is provided on an inner surface of the faceplate 2, while this phosphor layer 3 is formed by mixing $Y_2SiO_5$:Tb phosphors, the averaged particle diameter of which is 4 μm, with $Y_2SiO_5$:Tb small particle phosphors, the averaged particle diameter of which is 1 μm as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 9

MIM TYPE ELECTORN SOURCE DISPLAY—NO. 9

A display equipped with an MIM type electron source according to the present invention is indicated in FIG. 15. In particular, a phosphor layer 3 is provided on an inner surface of the faceplate 2, while this phosphor layer 3 is formed by mixing $Y_2SiO_5$:Tb phosphors, the averaged particle diameter of which is 4 μm, with ZnS:Cu small particle phosphors, the averaged particle diameter of which is 1 μm as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 10

MIM TYPE ELECTRON SOURCE DISPLAY—NO. 10

A display equipped with an MIM type electron source according to the present invention is indicated in FIG. 15. In particular, a phosphor layer 3 is provided on an inner surface of the faceplate 2, while this phosphor layer 3 is formed by mixing $Y_3$ (Al, Ga)$_5O_{12}$; Tb phosphors, the averaged particle diameter of which is 4 μm, with ZnS:Cu small particle phosphors, the averaged particle diameter of which is 1 μm as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 11

MIM TYPE ELECTORN SOURCE DISPLAY—NO. 11

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_3$:Eu phosphors, the averaged particle diameter of which is 4 $\mu$m, with $Y_2O_2S$:Eu small particle phosphors, the averaged particle diameter of which is 1 $\mu$m as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 12

MIM TYPE ELECTRON SOURCE DISPLAY—NO. 12

A display equipped with an MIM type electron source according to the present invention is indicated in FIG. 15. In particular, a phosphor layer 3 is provided on an inner surface of the faceplate 2, while this phosphor layer 3 is formed by mixing $SrTiO_3$:Pr phosphors, the averaged particle diameter of which is 4 $\mu$m, with $Y_2O_2S$:Eu small particle phosphors, the averaged particle diameter of which is 1 $\mu$m as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 13

SPINDT TYPE ELECTORN SOURCE DISPLAY—NO. 1

Figure 16:
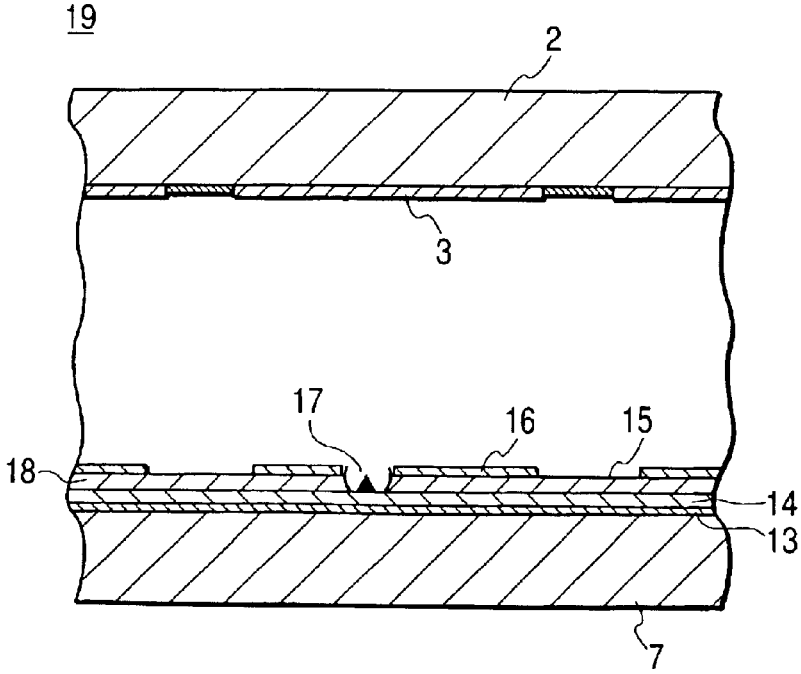
FIG. 16 is a schematic diagram for showing an entire arrangement of a display equipped with a spindt type electron source according to the present invention.

A display equipped with a spindt type electron source according to the present invention is indicated in FIG. 16. The display 19 equipped with the spindt type electron source is arranged by a faceplate 2, a spindt type electron source 18, and a rear plate 7. The spindt type electron source 18 is constituted by a cathode 13, a resistance layer 14, an insulator layer 15, a gate 16, a spindt type electron emitter (Mo etc.) 17. In particular, a phosphor layer 3 is provided on an inner surface of the faceplate 2, while this phosphor layer 3 is formed by mixing ZnS:Ag phosphors, the averaged particle diameter of which is 4 $\mu$m, with $Y_2SiO_5$:Ce small particle phosphors, the averaged particle diameter of which is 1 $\mu$m as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 14

SPINDT TYPE ELECTRON SOURCE DISPLAY—NO. 2

A display equipped with a spindt type electron source according to the present invention is indicated in FIG. 16. In particular, a phosphor layer 3 is provided on an inner surface of the faceplate 2, while this phosphor layer 3 is formed by mixing $Y_2O_2S$ Eu phosphors, the averaged particle diameter of which is 3 $\mu$m, with $Y_2O_2S$:Eu small particle phosphors, the averaged particle diameter of which is 0.8 $\mu$m as red phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 15

SPINDT TYPE ELECTRON SOURCE DISPLAY—NO. 3

A display equipped with a spindt type electron source according to the present invention is indicated FIG. 16. In particular, a phosphor layer 3 is provided on an inner surface of the faceplate 2, while this phosphor layer 3 is formed by mixing $Y_2SiO_5$:Tb phosphors, the averaged particle diameter of which is 4 $\mu$m, with $Y_2SiO_5$:Tb small particle phosphors, the averaged particle diameter of which is 1 $\mu$m as green phosphors. A method of forming a conductive material, a method of forming a black-color conductive material, and a method for forming a metal back are similar to those of the above-described concrete example 1. Both the luminescent maintenance factor and the energy efficiency of the light emission, according to the present invention, were good, which are similar to those of the concrete example 1.

Concrete Example 16

MIM TYPE ELECTORN SOURCE DISPLAY—NO. 13

A display equipped with an MIM type electron source according to the present invention is indicated in FIG. 15. The display 12 equipped with the MIM type electron source is arranged by a faceplate 2, an MIM type electron source 11, and a rear plate 7. The MIM type electron source 11 is constituted by a lower electrode (Al) 8, an insulating layer ($Al_2O_3$) 9, and also, an upper electrode (Ir—Pt—Au) 10. In particular, a phosphor layer 3 is provided on an inner surface of the faceplate 2, while this phosphor layer 3 is formed by mixing ZnS:Ag, Al phosphors, the averaged particle diameter of which is 8 $\mu$m, with ZnS:Ag, Al small particle phosphors, the averaged particle diameter of which is 4 $\mu$m, in 20 weight % as blue phosphors. A slurry method was conducted so as to coad the phosphor layer. A phosphor is distributed into a mixed water solution made from polyvinyl alcohol and dichromic acid so as to produce a slurry suspension. After the slurry suspension has been coated on the faceplate 2 and this faceplate 2 has been dried, the dried face plate 2 is exposed via a mask, and a phosphor is fixed thereon. The phosphor-fixed faceplate 2 is spray-developed by using warmed pure water, and then, a film of an unexposed portion is washed away, so that a phosphor pattern could be formed. In order to increase high resolution, a black-color conductive material was provided between one pixel. While the black-color conductive material is manufactured, a photoresist film is coated over an entire surface, this entire surface is exposed via a mask and is developed, and then, the photoresist film is partially left. Thereafter, after a graphite film has been formed over the entire surface, a hydrogen peroxide is effected so as to remove the photoresist film and the graphite formed on this photoresist film, so that the black-color conductive material could be formed. A metal back is formed in such a manner that after the inner surface of the phosphor layer 3 has been filming-processed, aluminium (Al) is vapor-deposited on this filming-processed inner surface. Thereafter, a thermal process is carried out to take away the filming agent, so that the metal back could be formed.

In a field-emission type display manufactured in accordance with the present invention, a luminescent lifetime thereof could be improved by 10%, as compared with a field-emission type display using the conventional phosphor layer.

Concrete Example 17

MIM TYPE ELECTORN SOURCE DISPLAY—NO. 14

A display equipped with an MIM type electron source according to the present invention is indicated in FIG. 15. In particular, a phosphor layer 3 is provided on an inner surface of the faceplate 2, while this phosphor layer 3 is formed by mixing ZnS:Ag, Al phosphors, the averaged particle diameter of which is 6 μm, with ZnS:Ag, Cl small particle phosphors, the averaged particle diameter of which is 3 μm as blue phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 18

MIM TYPE ELECTRNO SOURCE DISPLAY—NO. 15

A display equipped with an MIM type electron source according to the present invention is indicated in FIG. 15. In particular, a phosphor layer 3 is provided on an inner surface of the faceplate 2, while this phosphor layer 3 is formed by mixing ZnS:Cu, Al phosphors, the averaged particle diameter of which is 4 μm, with ZnS:Cu, Al small particle phosphors, the averaged particle diameter of which is 2 μm as green phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 19

MIMN TYPE ELECTRON SOURCE DISPLAY—NO. 16

A display equipped with an MIM type electron source according to the present invention is indicated in FIG. 15. In particular, a phosphor layer 3 is provided on an inner surface of the faceplate 2, while this phosphor layer 3 is formed by mixing $Y_2SiO_5$:Tb phosphors, the averaged particle diameter of which is 6 μm, with ZnS:Cu, Al small particle phosphors, the averaged particle diameter of which is 3 μm as green phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 20

MIM TYPE ELECTRON SOURCE DISPLAY—NO. 17

A display equipped with an MIM type electron source according to the present invention is indicated in FIG. 15. In particular, a phosphor layer 3 is provided on an inner surface of the faceplate 2, while this phosphor layer 3 is formed by mixing $Y_3(Al, Ga)_5O_{12}$:Tb phosphors, the averaged particle diameter of which is 8 μm, with ZnS:Cu, Al small particle phosphors, the averaged particle diameter of which is 4 μm as green phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 21

MIM TYPE ELECTRON SOURCE DISPLAY—NO. 18

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_2S$:Eu phosphors, the averaged particle diameter of which is 4 μm, with $Y_2O_2S$:Eu small particle phosphors, the averaged particle diameter of which is 2 μm, as red phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 22

MIM TYPE ELECTRON SOURCE DISPLAY—NO. 19

A display equipped with an MIM type electron source according to the present invention is indicated in FIG. 15. In particular, a phosphor layer 3 is provided on an inner surface of the faceplate 2, while this phosphor layer 3 is formed by mixing $Y_2O_2S$:Eu phosphors, the averaged particle diameter of which is 8 μm, with $Y_2O_3S$:Eu small particle phosphors, the averaged particle diameter of which is 4 μm, as red phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 23

SPINDT TYPE ELECTORN SOURCE DISPLAY—NO. 4

A display equipped with a spindt type electron source according to the present invention is indicated in FIG. 16. The display 19 equipped with the spindt type electron source is arranged by a faceplate 2, a spindt type electron source 18, and a rear plate 7. The spindt type electron source 18 is constituted by a cathode 13, a resistance layer 14, an insulator layer 15, a gate 16, a spindt type electron emitter (Mo etc.) 17.

In particular, a phosphor layer 3 is provided on an inner surface of the faceplate 2, while this phosphor layer 3 is formed by mixing ZnS:Ag,Al phosphors, the averaged particle diameter of which is 8 μm, with ZnS:Ag,Al small particle phosphors, the averaged particle diameter of which is 4 μm as blue phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 24

SPINDT TYPE ELECTRON SOURCE DISPLAY—NO. 5

A display equipped with a spindt type electron source according to the present invention is indicated FIG. 16. In particular, a phosphor layer 3 is provided on an inner surface of the faceplate 2, while this phosphor layer 3 is formed by mixing ZnS:Cu,Al phosphors, the averaged particle diameter of which is 6 μm, with $Y_2SiO_5$:Tb small particle phosphors, the averaged particle diameter of which is 3 μm as green phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 25

SPINDT TYPE ELECTRON SOURCE DISPLAY—NO. 6

A display equipped with a spindt type electron source according to the present invention is indicated in FIG. 16. In particular, a phosphor layer 3 is provided on an inner surface of the faceplate 2, while this phosphor layer 3 is formed by mixing $Y_2O_2S$ Eu phosphors, the averaged particle diameter of which is 6 μm, with $Y_2O_2S$:Eu small particle phosphors, the averaged particle diameter of which is 3 μm as red phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 26

CARBON NANO TUBE ELECTRON SOURCE DISPLAY—NO. 1

Figure 17:
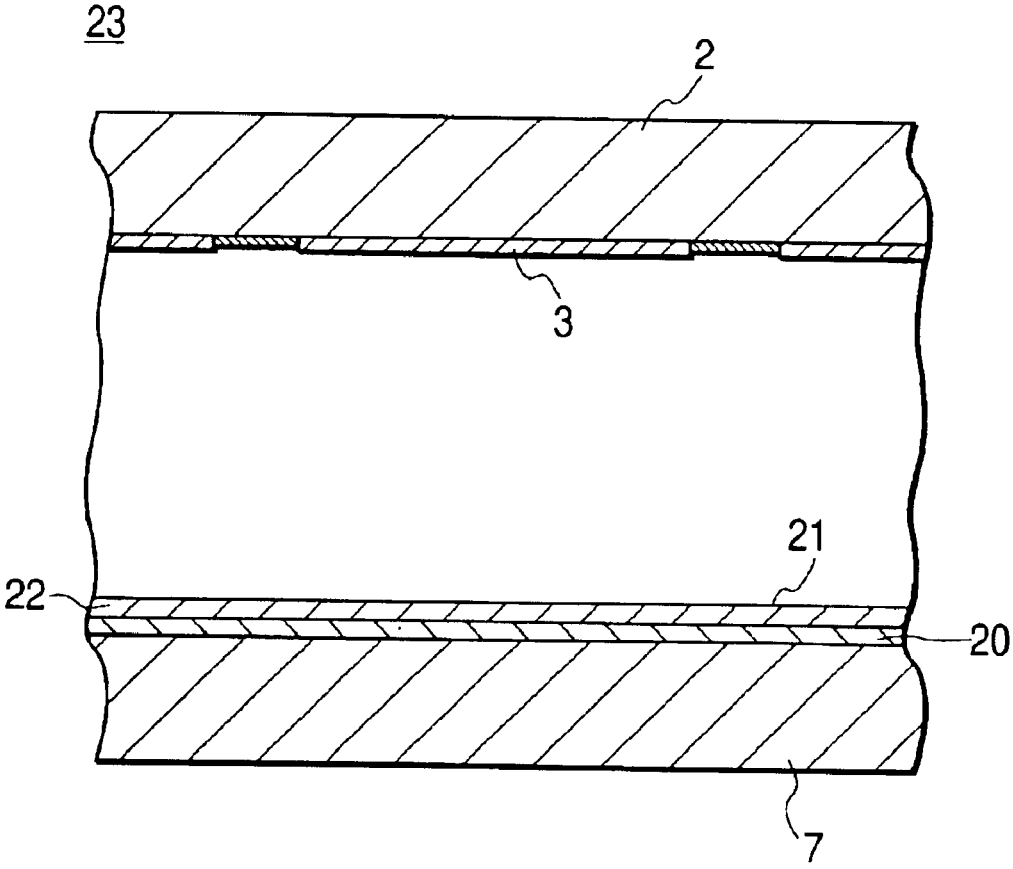
FIG. 17 is a schematic diagram for indicating an entire arrangement of a display equipped with a carbon nano tube type electron source.

A display equipped with a carbon nano tube type electron source is indicated in FIG. 17. The display 23 equipped with the carbon nano tube type electron source is arranged by a faceplate 2, a carbon nano tube type electron source 22, and a rear plate 7. The carbon nano tube type electron source 22 is constituted by an electrode 20, and a carbon nano tube layer 21. In particular, a phosphor layer 3 is provided on an inner surface of the faceplate 2, while this phosphor layer 3 is formed by mixing ZnS:Ag,Cl phosphors, the averaged particle diameter of which is 8 am, with ZnS:Ag,Cl small particle phosphors, the averaged particle diameter of which is 4 μm as blue phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 27

CARBON NANO TUBE ELECTRON SOURCE DISPLAY—NO. 2

A display equipped with a carbon nano tube type electron source is indicated in FIG. 17. In particular, a phosphor layer 3 is provided on an inner surface of the faceplate 2, while this phosphor layer 3 is formed by mixing ZnS:Cu,Al phosphors, the averaged particle diameter of which is 6 μm, with $Y_2SiO_5$:Tb small particle phosphors, the averaged particle diameter of which is 3 μm as green phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 28

CARBON NANO TUBE ELECTRON SOURCE DISPLAY—NO. 3

A display equipped with a carbon nano tube type electron source is indicated in FIG. 17. In particular, a phosphor layer 3 is provided on an inner surface of the faceplate 2, while this phosphor layer 3 is formed by mixing $Y_2O_2S$:Eu phosphors, the averaged particle diameter of which is 6 μm, with $Y_2O_3$:Eu small particle phosphors, the averaged particle diameter of which is 3 μm as red phosphors. A method of forming a phosphor layer, a method of forming a black-color conductive material, and a method for forming a metal back are similar to those of the above-described concrete example 16. The luminescent lifetime according to the present invention was good, which is similar to that of the concrete example 16.

Concrete Example 29

PROJECITON TUBE—NO. 1

A phosphor layer is provided on an inner surface of a faceplate of the projection tube according to the present invention, while this phosphor layer is formed by mixing $Y_2SiO_5$:Tb phosphor, the averaged particle diameter of which is 8 μm, with $YsSiO_5$:Tb small particle phosphors, the averaged particle diameter of which is 4 μm as green phosphors. A method for manufacturing the phosphor layer was carried out by way of a sedimentation method similar to that of the embodiment 4. The luminescent lifetime according to the present invention was good, which is similar to that of the concrete example 16.

Concrete Example 30

PROJECITON TUBE—NO. 2

A phosphor layer is provided on an inner surface of a faceplate of the projection tube according to the present invention, while this phosphor layer is formed by mixing ZnS:Ag,Al phosphor, the averaged particle diameter of which is 12 μm, with ZnS:Ag,Al small particle phosphors, the averaged particle diameter of which is 6 μm as blue phosphors. A method for manufacturing the phosphor layer was carried out by way of a sedimentation method similar to that of the embodiment 4. The luminescent lifetime according to the present invention was good, which is similar to that of the concrete example 16.

Concrete Example 31

PROJECITON TUBE—NO. 3

A phosphor layer is provided on an inner surface of a faceplate of the projection tube according to the present invention, while this phosphor layer is formed by mixing $Y_2O_3$:Eu phosphor, the averaged particle diameter of which is 8 μm, with $Y_2O_3$:Eu small particle phosphors, the averaged particle diameter of which is 4 μm as red phosphors. A method for manufacturing the phosphor layer was carried out by way of a sedimentation method similar to that of the embodiment 4. The luminescent lifetime according to the present invention was good, which is similar to that of the concrete example 16.

In the field-emission display and the projection tube, according to the present invention, the mixed small particle phosphors are entered into the spaces of the main phosphors, so that the contacts occurred among the phosphors may be increased, and also, the resistance of the entire phosphor layer may be suppressed. Also, the filling density of the phosphors may be increased, the surface area of the entire phosphors may be increased, and the electron density may be lowered. As a consequence, the long lifetime, and the high luminescence of the apparatus can be realized, and furthermore, the browning phenomenon of the phosphor layer can be mitigated.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A field-emission display apparatus comprising a face-plate on which a phosphor layer is formed, and a device for irradiating an electron beam onto said phosphor layer, wherein said phosphor layer comprises phosphors formed by mixing main phosphors with small particle phosphors, the average particle diameter of said small particle phosphors being less than 1/2 of an average particle diameter of said main phosphors.

2. A field-emission display apparatus comprising a face-plate on which a phosphor layer is formed, and a device for irradiating electron beams onto said phosphor layer, wherein said phosphor layer comprises phosphors formed by mixing main phosphors, the average particle diameter of which is expressed by "A", with small particle phosphors, the average particle diameter of which is expressed by "B", and wherein $0.16A \leqq 0.28A$.

3. The display apparatus as claimed in claim 2 wherein:

an accelerating voltage of said electron beam which is to be irradiated onto said phosphor layer is in a range of from 1 kV to 15 kV.

4. The display apparatus as claimed in claim 2 wherein:

said small particle phosphors are mixed with respect to said main phosphors in a range of from 2 weight % to 50 weight %.

5. The display apparatus as claimed in claim 2 wherein:

components of said main phosphors are identical to components of said small particle phosphors mixed with said main phosphors.

6. The display apparatus as claimed in claim 2 wherein:

said main phosphors are sulfur-system phosphors, and said small particle phosphors mixed with said main phosphors are oxide-system phosphors.

7. The display apparatus as claimed in claim 6 wherein:

said main phosphors are ZnS:Ag phosphors; and said small particle phosphors mixed with said main phosphors are any one sort, or plural sorts of the below-mentioned phosphors: $Y_2SiO_5$:Ce, $(Y,Gd)_2SiO_5$:Ce, $ZnGa_2O_4$, CaMg $Si_2O_6$:Eu, $Sr_3MgSi_2O_8$:Eu, $Sr_5(PO_4)_3$ Cl:Eu, $YNbO_4$; Bi.

8. The display apparatus as claimed in claim 6 wherein:

said main phosphors are $Y_2O_2S$:Eu phosphors; and said small particle phosphors mixed with said main phosphors are any one sort, or plural sorts of the below-mentioned phosphors $Y_2O_3$:Eu, $SrTiO_3$:Pr, $SnO_2$: Eu, $SrIn_2O_4$:Pr.

9. The display apparatus as claimed in claim 2 wherein:

said main phosphors are oxide-system phosphors, and said small particle phosphors mixed with said main phosphors are sulfur-system phosphors.

10. The display apparatus as claimed in claim 9 wherein:

said main phosphors are any one sort, or plural sorts of the below-mentioned phosphors: $Y_2SiO_5$:Tb, $(Y,Gd)_2SiO_5$:Tb, $Y_3(Al,Ga)_5O_{12}$: Tb, $(Y,Gd)3(A,Ga)_5O_{12}$:Tb, $ZnGa_2O_4$:Mn, $Zn(Ga,Al)_2O_4$:Mn, ZnO:Zn; and said small particle phosphors mixed with said main phosphors are any one sort, or plural sorts of the below-mentioned phosphors: ZnS:Cu, ZnS:Cu,Au.

11. The display apparatus as claimed in claim 9 wherein:

said main phosphors are any one sort, or plural sorts of the below-mentioned phosphors: $Y_2O_3$: Eu, $SrTiO_3$:Pr; and said small particle phosphors mixed with said main phosphors are $Y_2O_2S$: Eu phosphors.

12. A field-emission display apparatus comprising a face-plate on which a phosphor layer is formed, and a device for irradiating electron beams onto said phosphor layer, wherein said phosphor layer comprises phosphors formed by mixing main phosphors, the average particle diameter of which is expressed by "A", with small particle phosphors, the average particle diameter of which is expressed by "B", and wherein a volume of a position of said average particle diameter "B" is larger than a normal distribution curve by 2 weight % to 50 weight %.

13. The display apparatus as claimed in claim 12 wherein:

said phosphor layer is constituted by phosphors formed by mixing the main phosphors, the average particle diameter of which is expressed by "A", with the small particle phosphors, the average particle diameter of which is expressed by "B", and wherein a volume of a position of said average particle diameter "B" is larger than the normal distribution curve by 6 weight % to 12 weight %.

14. The display apparatus as claimed in claim 12 wherein:

said small particle phosphors are mixed with respect to said main phosphors in a range of from 2 weight % to 50 weight %.

15. The display apparatus as claimed in claim 12 wherein:

components of said main phosphors are identical to components of said small particle phosphors mixed with said main phosphors.

16. The display apparatus as claimed in claim 12 wherein:

said main phosphors are sulfur-system phosphors, and said small particle phosphors mixed with said main phosphors are oxide-system phosphors.

17. The display apparatus as claimed in claim 16 wherein:

said main phosphors are ZnS:Ag phosphors; and said small particle phosphors mixed with said main phosphors are any one sort, or plural sorts of the below-mentioned phosphors: $Y_2SiO_5$:Ce, $(Y,Gd)_2SiO_5$:Ce, $ZnGa_2O_4$, CaMg $Si_2O_6$:Eu, $Sr_3MgSi_2O_8$:Eu, $Sr_5(PO_4)_3$ Cl:Eu, $YNbO_4$; Bi.

18. The display apparatus as claimed in claim 16 wherein:

said main phosphors are $Y_2O_2S$:Eu phosphors; and said small particle phosphors mixed with said main phosphors are any one sort, or plural sorts of the below-mentioned phosphors: $Y_2O_3$:Eu, $SrTiO_3$:Pr, $SnO_2$:Eu, $SrIn_2O_4$:Pr.

19. The display apparatus as claimed in claim 12 wherein:

said main phosphors are oxide-system phosphors, and said small particle phosphors mixed with said main phosphors are sulfur-system phosphors.

20. The display apparatus as claimed in claim 19 wherein:

said main phosphors are any one sort, or plural sorts of the below-mentioned phosphors: $Y_2SiO_5$:Tb, $(Y,Gd)_2SiO_5$:Tb, $Y_3(Al,Ga)_5O_{12}$:Tb, $ZnGa_2O_4$:Mn, $Zn(Ga,Al)_2O_4$:Mn, ZnO:Zn; and said small particle phosphors mixed with said main phosphors are any one sort, or plural sorts of the below-mentioned phosphors: ZnS:Cu, ZnS:Cu,Au.

21. The display apparatus as claimed in claim 19 wherein:

said main phosphors are any one sort, or plural sorts of the below-mentioned phosphors: $Y_2O_3$: Eu, $SrTiO_3$:Pr; and said small particle phosphors mixed with said main phosphors are $Y_2O_2S$:Eu phosphors.

22. A projection tube apparatus comprising a faceplate on which a phosphor layer is formed, and a device for irradiating electron beams onto said phosphor layer, wherein said phosphor layer is formed by mixing small particle phosphors into main phosphors in a range greater than, or equal to 5 weight %, and less than, or equal to 70 weight %, and wherein an average particle diameter of said small particle phosphors is small with respect to an average particle diameter of the main phosphors.

23. A projection tube apparatus comprising a faceplate on which a phosphor layer is formed, and a device for irradiating electron beams onto said phosphor layer, wherein said phosphor layer is formed by mixing small particle phosphors into main phosphors in a range greater than, or equal to 10 weight %, and less than, or equal to 40 weight %, while an average particle diameter of said small particle phosphors is small with respect to an average particle diameter of the main phosphors.

24. The display apparatus as claimed in claim 23 wherein:

an accelerating voltage of an electron beam which is to be irradiated onto said phosphor layer is in a range of from 15 kV to 35 kV.

25. The display apparatus as claimed in claim 23 wherein:

components of said main phosphors are identical to components of said small particle phosphors mixed with said main phosphors.

26. A projection tube apparatus comprising a faceplate on which a phosphor layer is formed, and a device for irradiating electron beams onto said phosphor layer, wherein said phosphor layer is formed by mixing small particle phosphors into main phosphors in a range greater than, or equal to 5 weight %, and less than, or equal to 70 weight %, while an average particle diameter of said small particle phosphors is small with respect to an average particle size of the main phosphors.

27. A projection tube apparatus comprising a faceplate on which a phosphor layer is formed, and a device for irradiating electron beams onto said phosphor layer, wherein said phosphor layer s formed by mixing small particle phosphors into main phosphors in a range greater than, or equal to 10 weight %, and less than, or equal to 40 weight %, while an average particle diameter of said small particle phosphors is small with respect to an average particle diameter of the main phosphors.

* * * * *